US009473870B2

(12) United States Patent
Sen

(10) Patent No.: US 9,473,870 B2
(45) Date of Patent: Oct. 18, 2016

(54) LOUDSPEAKER POSITION COMPENSATION WITH 3D-AUDIO HIERARCHICAL CODING

(71) Applicant: QUALCOMM Incorporated, San Diego, CA (US)

(72) Inventor: Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 380 days.

(21) Appl. No.: 13/942,657

(22) Filed: Jul. 15, 2013

(65) Prior Publication Data

US 2014/0016802 A1 Jan. 16, 2014

Related U.S. Application Data

(60) Provisional application No. 61/672,280, filed on Jul. 16, 2012, provisional application No. 61/754,416, filed on Jan. 18, 2013.

(51) Int. Cl.

| | |
|---|---|
| ***H04R 5/00*** | (2006.01) |
| ***H04S 3/00*** | (2006.01) |
| *H04S 7/00* | (2006.01) |

(52) U.S. Cl.

CPC ..... *H04S 3/006* (2013.01); *H04S 3/002* (2013.01); *H04S 7/30* (2013.01); *H04S 2400/03* (2013.01); *H04S 2420/11* (2013.01)

(58) Field of Classification Search

None

See application file for complete search history.

(56) References Cited

U.S. PATENT DOCUMENTS

| | | | |
|---|---|---|---|
| 6,904,152 | B1 | 6/2005 | Moorer |
| 7,298,853 | B2 | 11/2007 | Norris et al. |
| 7,447,317 | B2 | 11/2008 | Herre et al. |
| 7,602,922 | B2 | 10/2009 | Breebaart et al. |
| 7,606,373 | B2 | 10/2009 | Moorer |
| 7,660,424 | B2 | 2/2010 | Davis |
| 8,145,498 | B2 | 3/2012 | Herre et al. |
| 9,190,065 | B2 | 11/2015 | Sen |
| 9,288,603 | B2 * | 3/2016 | Sen ..... G10L 19/008 |

(Continued)

FOREIGN PATENT DOCUMENTS

| | | | |
|---|---|---|---|
| CN | 1507701 | A | 6/2004 |
| CN | 1735922 | A | 2/2006 |

(Continued)

OTHER PUBLICATIONS

Boehm, "Decoding for 3D," Convention Paper 8426, AES Convention 130; May 13-16, 2011, Audio Engineering Society, 60 East 42nd Street, Room 2520, New York, New York 10165-2520, USA, May 13, 2011, XP040567441, 16 pp.

(Continued)

*Primary Examiner* — Thang Tran

(74) *Attorney, Agent, or Firm* — Shumaker & Sieffert, P.A.

(57) ABSTRACT

In general, techniques are described for compensating for loudspeaker positions using hierarchical three-dimensional (3D) audio coding. An apparatus comprising or more processors may perform the techniques. The processors may be configured to perform a first transform that is based on a spherical wave model on a first set of audio channel information for a first geometry of speakers to generate a first hierarchical set of elements that describes a sound field. The processors may further be configured to perform a second transform in a frequency domain on the first hierarchical set of elements to generate a second set of audio channel information for a second geometry of speakers.

149 Claims, 16 Drawing Sheets

(56) References Cited

U.S. PATENT DOCUMENTS

| | | | | |
|---|---|---|---|---|
| 2003/0007648 | A1* | 1/2003 | Currell | H04S 7/30 381/61 |
| 2004/0247134 | A1 | 12/2004 | Miller, III | |
| 2006/0045275 | A1 | 3/2006 | Daniel | |
| 2009/0265164 | A1 | 10/2009 | Yoon et al. | |
| 2009/0313029 | A1 | 12/2009 | Luo et al. | |
| 2010/0169102 | A1 | 7/2010 | Samsudin et al. | |
| 2010/0228552 | A1 | 9/2010 | Suzuki et al. | |
| 2011/0261973 | A1* | 10/2011 | Nelson | H04S 3/00 381/107 |
| 2012/0014527 | A1 | 1/2012 | Furse | |
| 2012/0093323 | A1 | 4/2012 | Lee et al. | |
| 2012/0155653 | A1 | 6/2012 | Jax et al. | |
| 2012/0232910 | A1 | 9/2012 | Dressler et al. | |
| 2012/0314878 | A1 | 12/2012 | Daniel et al. | |
| 2013/0010971 | A1 | 1/2013 | Batke et al. | |
| 2013/0148812 | A1 | 6/2013 | Corteel et al. | |
| 2014/0016784 | A1 | 1/2014 | Sen et al. | |
| 2014/0016786 | A1* | 1/2014 | Sen | G10L 19/008 381/23 |
| 2014/0016802 | A1 | 1/2014 | Sen | |
| 2014/0023197 | A1* | 1/2014 | Xiang | H04S 1/007 381/17 |
| 2014/0025386 | A1* | 1/2014 | Xiang | G10L 19/008 704/500 |
| 2014/0146984 | A1* | 5/2014 | Kim | H04R 5/00 381/307 |
| 2014/0219455 | A1* | 8/2014 | Peters | H04S 5/00 381/17 |
| 2014/0219456 | A1* | 8/2014 | Morrell | H04S 5/00 381/17 |
| 2014/0355768 | A1* | 12/2014 | Sen | G10L 19/008 381/23 |
| 2015/0154965 | A1* | 6/2015 | Wuebbolt | G10L 19/008 704/500 |
| 2015/0163615 | A1 | 6/2015 | Boehm et al. | |

FOREIGN PATENT DOCUMENTS

| | | | |
|---|---|---|---|
| CN | 101044550 | A | 9/2007 |
| CN | 102122509 | A | 7/2011 |
| CN | 102547549 | A | 7/2012 |
| EP | 2094032 | A1 | 8/2009 |
| EP | 2469741 | A1 | 6/2012 |
| GB | 2478834 | A | 9/2011 |
| JP | H09244663 | A | 9/1997 |
| WO | 2012023864 | A1 | 2/2012 |
| WO | 2013000740 | A1 | 1/2013 |
| WO | 2013068402 | A1 | 5/2013 |
| WO | 2015059081 | A1 | 4/2015 |

OTHER PUBLICATIONS

Craven et al., "Hierarchical Lossless Transmission of Surround Sound Using MLP," AES 24th International Conference on Multichannel Audio, Jun. 2003, 17 pp.

Engdegard et al. "Spatial Audio Object Coding (SAOC)—The Upcoming MPEG Standard on Parametric Object Based Audio Coding," Proc. of the 124th AES Convention, May 17-20, 2008, 15 pp.

Jot et al., "A backward compatible and scalable approach to 3-D Audio Coding," MPEG 3D Audio Workshop, at the 99th MPEG meeting in San Jose, CA, Feb. 8, 2012, 25 pp.

"SRS Labs Successfully Completes Development of Multi-Dimensional Audio Specification 1.0; MDA Platform Enters Beta Testing Phase," BusinessWire, Mar. 22, 2012, Retrieved from Internet: URL: http://www.businesswire.com/news/home/20120322005556/en/SRS-Labs-Successfully-Completes-Development-Multi-Dimensional-Audio#.VbvXGPmqqkp, 3 pp.

"MDA; Object-Based Audio Immersive Sound Metadata and Bitstream," EBU Operating Eurovision, ETSI TS 103 223 V1.1.1, Apr. 2015, 75 pp.

Melchior et al., "Spatial Audio Authoring for Ambisonic Reproduction," 1st Ambisonics Symposium, Graz, Austria, Jun. 25-27, 2009, 7 pp.

Painter et al., "Perceptual Coding of Digital Audio," Proceedings of the IEEE, vol. 88, No. 4, Apr. 2000, pp. 451-513, 63 pp.

Poletti, "Unified Description of Ambisonics Using Real and Complex Spherical Harmonics," Ambisonics Symposium Jun. 25-27, 2009, Graz, Austria, 10 pp.

Sen et al., "Differences and similarities in formats for scene based audio," ISO/IEC JTC1/SC29/WG11 MPEG2012/M26704, Oct. 2012, Shanghai, China, 7 pp.

Sen et al., "Psychoacoustically Motivated, Frequency Dependent Tikhonov Regularization for Soundfield Parametrization," Proc. IEEE International Conference on Acoustics Speech and Signal Processing (ICASSP), Mar. 2010, 4 pp.

Zyber, "SRS Labs Multi-Dimensional Audio High Def Digest," The Bonus View, May 24, 2012, Retrieved from Internet: URL:http://www.highdefdigest.com/blog/srs-labs-mda-audio/, 4 pp.

Second Written Opinion from International Application No. PCT/US2013/050648, dated Jul. 16, 2014, 5 pp.

ISO/IEC 14496-3: 2009, "Information technology—Coding of audio-visual objects—Part 3: Audio," Int'l Org. for Standardization, Geneva, CH, Mar. 2009, 1404 pp.

International Preliminary Report on Patentability from International Application No. PCT/US2013/050648, dated Nov. 3, 2014, 8 pp.

Advanced Television Systems Committee (ATSC): "ATSC Standard: Digital Audio Compression (AC-3, E-AC-3)," Doc. A/52:2012, Digital Audio Compression Standard, Mar. 23, 2012, 269 Pages, Accessed online Jul. 15, 2012 < URL: www.atsc.org/cms/standards >.

Bates E., "The Composition and Performance of Spatial Music", Ph.D. thesis, Univ. of Dublin, Aug. 2009, pp. 257, Accessed online Jul. 22, 2013 at http://endabates.net/Enda%20Bates%20-%20The%20Composition%20and%20Performance%20of%20S-qjpatial%20Music.pdf.

Breebaart J., et al., "Background, Concept, and Architecture for the Recent MPEG Surround Standard on Multichannel Audio Compression", pp. 21, J. Audio Eng. Soc., vol. 55, No. 5, May 2007, Accessed online Jul. 9, 2012; available online Jul. 22, 2013 at www.jeroenbreebaart.com/papers/jaes/jaes2007.pdf.

Breebaart J., et al., "Binaural Rendering in MPEG Surround", EURASIP Journal on Advances in Signal Processing, vol. 2008, Article ID 732895, 1-14 pages.

Breebaart J., et al., "MPEG Spatial Audio coding/MPEG surround: Overview and Current Status," Audio Engineering Society Convention Paper, Presented at the 119th Convention, Oct. 7-10, 2005, USA, 17 pages.

Breebaart J., et al., "Parametric Coding of Stereo Audio", EURASIP Journal on Applied Signal Processing 2005:9, pp. 1305-1322.

Bruno Remy., et al., "Reproducing Multichannel Sound on any Speaker Layout", AES Convention 118; May 28-31, 2005, AES, Barcelona, Spain, May 28, 2005 (May 28, 2005), XP040507183, 18 pp.

Daniel J., "Spatial Sound Encoding Including Near Field Effect: Introducing Distance Coding Filters and a Viable, New Ambisonic Format," AES 23rd International Conference, Copenhagen, Denmark, May 23-25, 2003 (corrected Jul. 21, 2006), pp. 15, Accessed online [Jul. 8, 2013] at <URL: http://gyronymo.free.fr/audio3D/publications/AES23NFCHOA_revised2006.pdf>.

European Broadcasting Union (EBU): "Specification of the Broadcast Wave Format (BWF): A format for audio data files in broadcasting, Supplement 1—MPEG audio", EBU-TECH 3285-E Supplement 1, Jul. 1997, Geneva, CH. pp. 14, Available online Jul. 22, 2013 at https://tech.ebu.ch/docs/tech/tech3285s1.pdf.

European Broadcasting Union (EBU): "Specification of the Broadcast Wave Format (BWF): A format for audio data files in broadcasting, Supplement 2—Capturing Report", EBU-TECH 3285 Supplement 2, Jul. 2001, Geneva, CH. pp. 14, Available online Jul. 22, 2013 at https://tech.ebu.ch/docs/tech/tech3285s2.pdf.

European Broadcasting Union (EBU): "Specification of the Broadcast Wave Format (BWF): A format for audio data files in broadcasting, Supplement 3—Peak Envelope Chunk", EBU-TECH 3285 Supplement 3, Jul. 2001, Geneva, CH. pp. 8, Available online Jul. 22, 2013 at https://tech.ebu.ch/docs/tech/tech3285s3.pdf.

(56) References Cited

OTHER PUBLICATIONS

European Broadcasting Union (EBU): "Specification of the Broadcast Wave Format (BWF): A format for audio data files in broadcasting, Supplement 4: <link> Chunk", EBU-TECH 3285 Supplement 4, Apr. 2003, Geneva, CH. pp. 4, Available online Jul. 22, 2013 at https://tech.ebu.ch/docs/tech/tech3285s4.pdf.
European Broadcasting Union (EBU): "Specification of the Broadcast Wave Format (BWF): A format for audio data files in broadcasting, Supplement 5: <axml> Chunk", EBU-TECH 3285 Supplement 5, Jul. 2003, Geneva, CH. pp. 3, Available online Jul. 22, 2013 at https://tech.ebu.ch/docs/tech/tech3285s5.pdf.
European Broadcasting Union (EBU): "Specification of the Broadcast Wave Format (BWF): A format for audio data files in broadcasting Version 2.0.", EBU-TECH 3285, May 2011, Geneva, CH. pp. 20, Available online Jul. 22, 2013 at https://tech.ebu.ch/docs/tech/tech3285.pdf.
European Broadcasting Union (EBU): "Specification of the Broadcast Wave Format (BWF): A format for audio data files, Supplement 6: Dolby Metadata, <dbmd> chunk", EBU-TECH 3285 suppl.6, Oct. 2009, Geneva, CH. pp. 46, Available online Jul. 22, 2013 at https://tech.ebu.ch/docs/tech/tech3285s6.pdf.
Fraunhofer Institute for Integrated Circuits: "White Paper: An Introduction to MP3 Surround", 2012, pp. 17, Accessed online Jul. 10, 2012; available online Jul. 22, 2013 at http://www.iis.fraunhofer.de/content/dam/iis/de/dokunnente/amm/wp/introduction_mp3surround_03-2012.pdf.
Gupta A., et al., "Three-Dimensional Sound Field Reproduction Using Multiple Circular Loudspeaker Arrays," IEEE Transactions on Audio, Speech, and Language Processing, vol. 19, No. 5, Jul. 2011, pp. 1149-1159.
Herre J., "Efficient Representation of Sound Images: Recent Developments in Parametric Coding of Spatial Audio," pp. 40, Accessed online Jul. 9, 2012; accessed online Jul. 22, 2012 at www.img.lx.it.pt/pcs2007/presentations/JurgenHere_Sound_Images.pdf.
Herre J., et al., "An Introduction to MP3 Surround", pp. 9, Accessed online Jul. 10, 2012; available online Jul. 22, 2013 at http://www.iis.fraunhofer.de/content/dam/iis/en/dokumente/AMM/introduction_to_mp3surround.pdf.
Herre J., et al., "MPEG Surround—The ISO/MPEG Standard for Efficient and Compatible Multichannel Audio Coding", J. Audio Eng. Soc., vol. 56, No. 11, Nov. 2008, pp. 24, Accessed online Jul. 9, 2012; available online Jul. 22, 2013 at www.jeroenbreebaart.com/papers/jaes/jaes2008.pdf.
Herre J., et al., "The Reference Model Architecture for MPEG Spatial Audio Coding", May 28-31, 2005, 118th Convention, Barcelona, Spain, pp. 13, Accessed online Jul. 11, 2012; available online Jul. 22, 2013 at http://www.iis.fraunhofer.de/content/dam/iis/de/dokumente/amm/conference/AES6447_MPEG_Spatial_Audio_Reference_Model_Architecture.pdf.
Herre J., "Personal Audio: From Simple Sound Reproduction to Personalized Interactive Rendering", pp. 22, Accessed online Jul. 9, 2012; available online Jul. 22, 2013 at http://www.audiomostly.com/amc2007/programme/presentations/AudioMostlyHerre.pdf.
International Telecommunication Union (ITU): "Recommendation ITU-R BS.775-1: Multichannel Stereophonic Sound System With and Without Accompanying Picture", pp. 10, Jul. 1994.
Laborie A., et al., "A New Comprehensive Approach of Surround Sound Recording," AES Convention: 114, Amsterdam, The Netherlands, Paper No. 5717, Mar. 22-25, 2003, 20 Pages.
Malham D., "Spherical Harmonic Coding of Sound Objects—the Ambisonic 'O' Format," pp. 4, Accessed online Jul. 13, 2012; available online Jul. 22, 2013 at <URL: pcfarina.eng.unipr.it/Public/O-format/AES19-Malham.pdf>.
Poletti M., "Three-Dimensional Surround Sound Systems Based on Spherical Harmonics," The Journal of the Audio Engineering Society, Nov. 2005, pp. 1004-1025, vol. 53, No. 11.
"Transforming Ambiophonic + Ambisonic 3D Surround Sound to & from ITU 5.1 /6.1", AES 114th Convention, Amsterdam, The Netherlands, pp. 10165-2520, Mar. 22-25, 2003, XP04037217.
"Wave PCM soundfile format", pp. 4, Accessed online Dec. 3, 2012 at https://ccrma.stanford.edu/courses/422/projects/WaveFormat/.
Zotter Franz., et al., "The Virtual T-Design Ambisonics-Rig Using VBAP", 1st EAA—EuroRegio Congress on Sound and Vibration, Sep. 15-18, 2010 (Sep. 16, 2010), XP002713480, Retrieved from the Internet: URL:http:ffold.iem.at/Members/zotter/2010_ZotterFrankSontacchi_tdsgnAmbiVBAP_Euroreg io.pdf, [retrieved on Sep. 19, 2013], 4 pp.
International Search Report on Patentability from International Application No. PCT/US2013/046369, dated Sep. 25, 2013, 11 pp.
International Search Report on Patentability from International Application No. PCT/US2013/050648, dated Oct. 9, 2013, 17 pp.
Jerome D., "Spatial Sound Encoding Including Near Field Effect: Introducing Distance Coding Filters and a Viable, New Ambisonic Format," AES 23rd International Conference, Copenhagen, Denmark, May 23-25, 2003 (corrected Jul. 21, 2006), pp. 15, XP040374490, Accessed online [Jul. 8, 2013] at <URL: http://gyronymo.free.fr/audio3D/publications/AES23NFCHOA_revised2006.pdf>.

* cited by examiner

LOUDSPEAKER POSITION COMPENSATION WITH 3D-AUDIO HIERARCHICAL CODING

This application claims the benefit of U.S. Provisional Application No. 61/672,280, filed Jul. 16, 2012 and U.S. Provisional Application No. 61/754,416 filed Jan. 18, 2013.

TECHNICAL FIELD

This disclosure relates to spatial audio coding.

BACKGROUND

There are various 'surround-sound' formats that range, for example, from the 5.1 home theatre system to the 22.2 system developed by NHK (Nippon Hoso Kyokai or Japan Broadcasting Corporation). Often, these so-called surround-sound formats specify locations at which speakers are to be positioned such that the speakers may best reproduce the sound field at the audio playback system. Yet, those who have audio playback systems that support one or more of the surround sound formats often do not accurately place the speakers at the format specified locations, often because the room in which the audio playback system is located has limitations on where the speakers may be placed. While certain formats are more flexible than other formats in terms of where the speakers may be positioned, some formats have been more widely adopted, resulting in consumers being hesitant to upgrade or transition to these more flexible formats due to high costs associated with the upgrade or transition to the more flexible formats.

SUMMARY

This disclosure describes methods, systems, and apparatus that may be used to address this lack of backward compatibility while also facilitating transition to more flexible surround sound formats (again, these formats are "more flexible" in terms of where the speakers may be located). The techniques described in this disclosure may provide for various ways of both sending and receiving backward compatible audio signals that may accommodate transformation to spherical harmonic coefficients (SHC) that may provide a two-dimensional or three-dimensional representation of the sound field. By enabling transformation of backward compatible audio signals, such as those that conform to a 5.1 surround sound format, into the SHC, the techniques may recover a three-dimensional representation of the sound field that may be mapped to nearly any speaker geometry.

In one aspect, a method of audio signal processing comprises transforming, with a first transform that is based on a spherical wave model, a first set of audio channel information for a first geometry of speakers into a first hierarchical set of elements that describes a sound field, and transforming in a frequency domain, with a second transform, the first hierarchical set of elements into a second set of audio channel information for a second geometry of speakers.

In another aspect, an apparatus comprises one or more processors configured to perform a first transform that is based on a spherical wave model on a first set of audio channel information for a first geometry of speakers to generate a first hierarchical set of elements that describes a sound field, and to perform a second transform in a frequency domain on the first hierarchical set of elements to generate a second set of audio channel information for a second geometry of speakers.

In another aspect, an apparatus comprises means for transforming, with a first transform that is based on a spherical wave model, a first set of audio channel information for a first geometry of speakers into a first hierarchical set of elements that describes a sound field, and means for transforming in a frequency domain, with a second transform, the first hierarchical set of elements into a second set of audio channel information for a second geometry of speakers.

In another aspect, a non-transitory computer-readable storage medium has stored thereon instructions that, when executed, cause one or more processors to transform, with a first transform that is based on a spherical wave model, a first set of audio channel information for a first geometry of speakers into a first hierarchical set of elements that describes a sound field, and transform in a frequency domain, with a second transform, the first hierarchical set of elements into a second set of audio channel information for a second geometry of speakers.

In another aspect, a method comprises receiving loudspeaker channels along with coordinates of a first geometry of speakers, wherein the loudspeaker channels have been transformed into hierarchical set of elements.

In another aspect, an apparatus comprises one or more processors configured to receive loudspeaker channels along with coordinates of a first geometry of speakers, wherein the loudspeaker channels have been transformed into hierarchical set of elements.

In another aspect, an apparatus comprises means for receiving loudspeaker channels along with coordinates of a first geometry of speakers, wherein the loudspeaker channels have been transformed into hierarchical set of elements.

In another aspect, a non-transitory computer-readable storage medium comprising instructions that, when executed, cause one or more processors to receive loudspeaker channels along with coordinates of a first geometry of speakers, wherein the loudspeaker channels have been transformed into hierarchical set of elements.

In another aspect, a method comprises transmitting loudspeaker channels along with coordinates of a first geometry of speakers, wherein the first geometry corresponds to locations of the channels.

In another aspect, an apparatus comprises one or more processors configured to transmit loudspeaker channels along with coordinates of a first geometry of speakers, wherein the geometry corresponds to the locations of the channels.

In another aspect, an apparatus comprises means for transmitting loudspeaker channels along with coordinates of a first geometry of speakers, wherein the geometry corresponds to the locations of the channels.

In another aspect, a non-transitory computer-readable storage medium having stored thereon instructions that, when executed, cause one or more processors to transmit loudspeaker channels along with coordinates of a first geometry of speakers, wherein the geometry corresponds to the locations of the channels.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
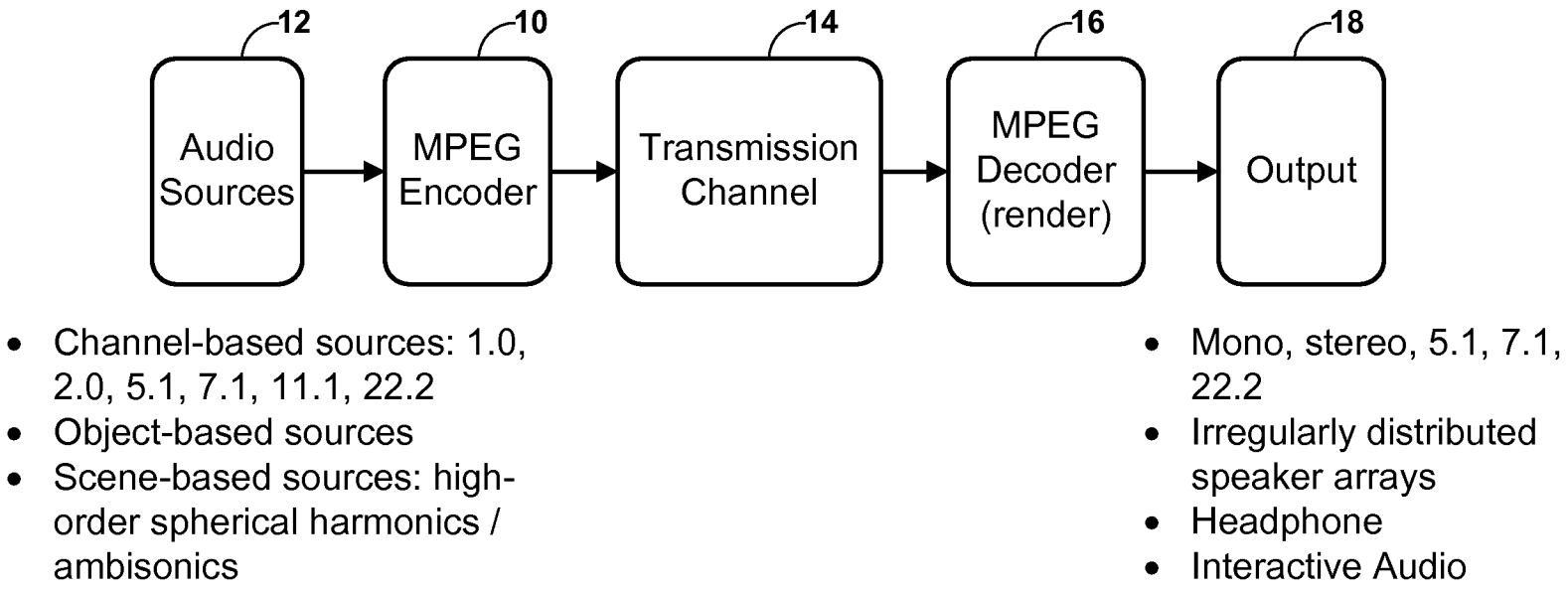
FIG. 1 is a diagram illustrating a general structure for standardization using a codec.

Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, estimating, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Unless expressly limited by its context, the term "selecting" is used to indicate any of its ordinary meanings, such as identifying, indicating, applying, and/or using at least one, and fewer than all, of a set of two or more. Where the term "comprising" is used in the present description and claims, it does not exclude other elements or operations. The term "based on" (as in "A is based on B") is used to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including "in response to at least."

References to a "location" of a microphone of a multi-microphone audio sensing device indicate the location of the center of an acoustically sensitive face of the microphone, unless otherwise indicated by the context. The term "channel" is used at times to indicate a signal path and at other times to indicate a signal carried by such a path, according to the particular context. Unless otherwise indicated, the term "series" is used to indicate a sequence of two or more items. The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the futuristic 22.2 format (e.g., for use with the Ultra High Definition Television standard). Further examples include formats for a spherical harmonic array. It may be desirable for a surround sound format to encode audio in two dimensions and/or in three dimensions.

It may be desirable to follow a 'create-once, use-many' philosophy in which audio material is created once (e.g., by a content creator) and encoded into formats which can subsequently decoded and rendered to different outputs and speaker setups.

The input to the future MPEG encoder is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are a multitude of advantages of using the third, scene-based format. However, one possible disadvantage of using this format is a lack of backward compatibility to existing consumer audio systems. For example, most existing systems accept 5.1 channel input. Traditional channel-based matrixed audio can bypass this problem by having the 5.1 samples as a subset of the extended channel format. In the bit-stream, the 5.1 samples are in a location recognized by existing (or "legacy") systems, and the extra channels can be located in an extended portion of the frame packet that contains all channel samples. Alternatively, the 5.1 channel data can be determined from a matrixing operation on the higher number of channels.

The lack of backward compatibility when using SHC is due to the fact that SHC are not PCM data. This disclosure describes methods, systems, and apparatus that may be used to address this lack of backward compatibility when using coefficients of spherical harmonic basis functions (also called "spherical harmonic coefficients" or SHC) to represent the sound field.

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. It may be desirable to provide an encoding into a standardized bit stream and a subsequent decoding that is adaptable and agnostic to the speaker geometry and acoustic conditions at the location of the renderer.

FIG. 1 illustrates a general structure for such standardization, using a Moving Picture Experts Group (MPEG) codec, to provide the goal of a uniform listening experience regardless of the particular setup that is ultimately used for reproduction. As shown in FIG. 1, MPEG encoder 10 encodes audio sources 12 to generate an encoded version of the audio sources 12, where the encoded version of the audio sources 12 are sent via transmission channel 14 to MPEG decoder 16. The MPEG decoder 16 decodes the encoded version of audio sources 12 to recover, at least partially, the audio sources 12. The recovered version of the audio sources 12 is shown as output 18 in the example of FIG. 1.

Backward compatibility was an issue even when the stereophonic format was introduced, as it was necessary for legacy monophonic-playback systems to retain compatibility. Mono-stereo backward compatibility was retained using matrixing. The stereo 'M-middle' and 'S-Side' format is able to retain compatibility with mono-capable systems by using just the M channel.

Figure 2:
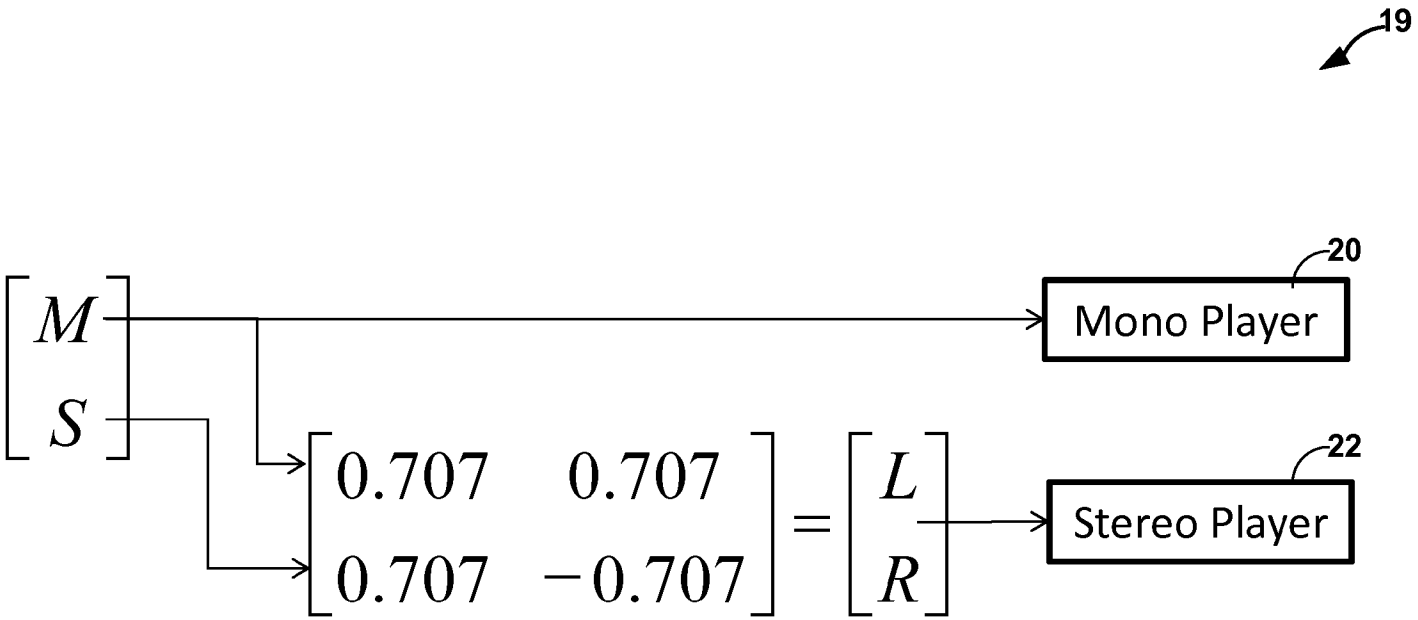
FIG. 2 is a diagram illustrating a backward compatible example for mono/stereo.

FIG. 2 is a diagram illustrating a stereo-capable system 19 that may perform a simple 2×2 matrix operation to decode the 'L-left' and 'R-Right' channels. The M-S signal can be computed from the L-R signal by using the inverse of the above matrix (which happens to be identical). In this manner, a legacy mono player 20 retains functionality, while a stereo player 22 can decode the Left and Right channels accurately. In a similar manner, a third channel can be added that retains backward-compatibility, preserving the functionality of the mono-player 20 and the stereo-player 22 and adding functionality of a three-channel player.

One proposed approach for addressing the issue of backward compatibility in an object-based format is to send a downmixed 5.1 channel signal along with the objects. In such a scenario, the legacy 5.1 systems would play the downmixed channel-based audio while more advanced renderers would either use a combination of the 5.1 audio and the individual audio objects, or just the individual objects, to render the sound field.

It may be desirable to use a hierarchical set of elements to represent a sound field. A hierarchical set of elements is a set in which the elements are ordered such that a basic set of lower-ordered elements provides a full representation of the modeled sound field. As the set is extended to include higher-order elements, the representation becomes more detailed.

One example of a hierarchical set of elements is a set of SHC. The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \phi_r\}$ of the sound field can be represented uniquely by the SHC $A_n^m(k)$. Here, $$k = \frac{\omega}{c},$$

c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

The above equation, in addition to being in the frequency domain, also represents a spherical wave model that enables derivation of the SHC for different radial distances (or "radii"). That is, the SHC may be derived for different radii, r, meaning that the SHC accommodates for sources positioned at various and different distances from the so-called "sweet spot" or where the listener is intended to listen. The SHC may then be used to determine speaker feeds for irregular speaker geometries having speakers that reside on different spherical surfaces and thereby potentially better reproduce the sound field using the speakers of the irregular speaker geometry. In this respect, rather than receive radial information (e.g., such as radii measured from the sweet spot to the speaker) of those speakers that are not on the same spherical surface as the other speakers and then introducing delay to compensate for the wave front spreading, the SHC may be derived using the above equation to more accurately reproduce the sound field at different radial distances.

The SHC $A_n^m(k)$ can either be physically acquired (e.g., recorded) by various microphone array configurations or, alternatively, they can be derived from channel-based or object-based descriptions of the sound field. The former represents scene-based audio input to a proposed encoder. For example, a fourth-order representation involving 25 coefficients may be used.

The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$. One of skill in the art will recognize that the above expressions may appear in the literature in slightly different form.

This disclosure includes descriptions of systems, methods, and apparatus that may be used to convert a subset (e.g., a basic set) of a complete hierarchical set of elements that represents a sound field (e.g., a set of SHC, which might otherwise be used if backward compatibility were not an issue) to multiple channels of audio (e.g., representing a traditional multichannel audio format). Such an approach may be applied to any number of channels that are desired to maintain backward compatibility. It may be expected that such an approach would be implemented to maintain compatibility with at least the traditional 5.1 surround/home theatre capability. For the 5.1 format, the multichannel audio channels are Front Left, Center, Front Right, Left Surround, Right Surround and Low Frequency Effects (LFE). The total number of SHC may depend on various factors. For scene-based audio, for example, the total number of SHC may be constrained by the number of microphone transducers in the recording array. For channel- and object-based audio, the total number of SHC may be determined by the available bandwidth.

The encoded channels may be packed into a corresponding portion of a packet that is compliant with a desired corresponding channel-based format. The rest of the hierarchical set (e.g., the SHC that were not part of the subset) would not be converted and instead may be encoded for transmission (and/or storage) alongside the backward-compatible multichannel audio. For example, these encoded bits may be packed into an extended portion of the packet for the frame (e.g., a user-defined portion).

In another embodiment, an encoding or transcoding operation can be carried out on the multichannel signals. For example, the 5.1 channels can be coded in AC3 format (also called ATSC A/52 or Dolby Digital) to retain backward compatibility with AC3 decoders that are in many consumer devices and set-top boxes. Even in this scenario, the rest of the hierarchical set (e.g., the SHC that were not part of the subset) would be encoded separately and transmitted (and/or stored) in one or more extended portions of the AC3 packet (e.g., auxdata). Other examples of target formats that may be used include Dolby TrueHD, DTS-HD Master Audio, and MPEG Surround.

At the decoder, legacy systems would ignore the extended portions of the frame-packet, using only the multichannel audio content and thus retaining functionality.

Advanced renderers may be implemented to perform an inverse transform to convert the multichannel audio to the original subset of the hierarchical set (e.g., a basic set of SHC). If the channels have been re-encoded or transcoded, an intermediate step of decoding may be performed. The bits in the extended portions of the packet would be decoded to extract the rest of the hierarchical set (e.g., an extended set of SHC). In this manner, the complete hierarchical set (e.g., set of SHC) can be recovered to allow various types of sound field rendering to take place.

Examples of such a backward compatible system are summarized in the following system diagrams, with explanations on both encoder and decoder structures.

Figure 3:
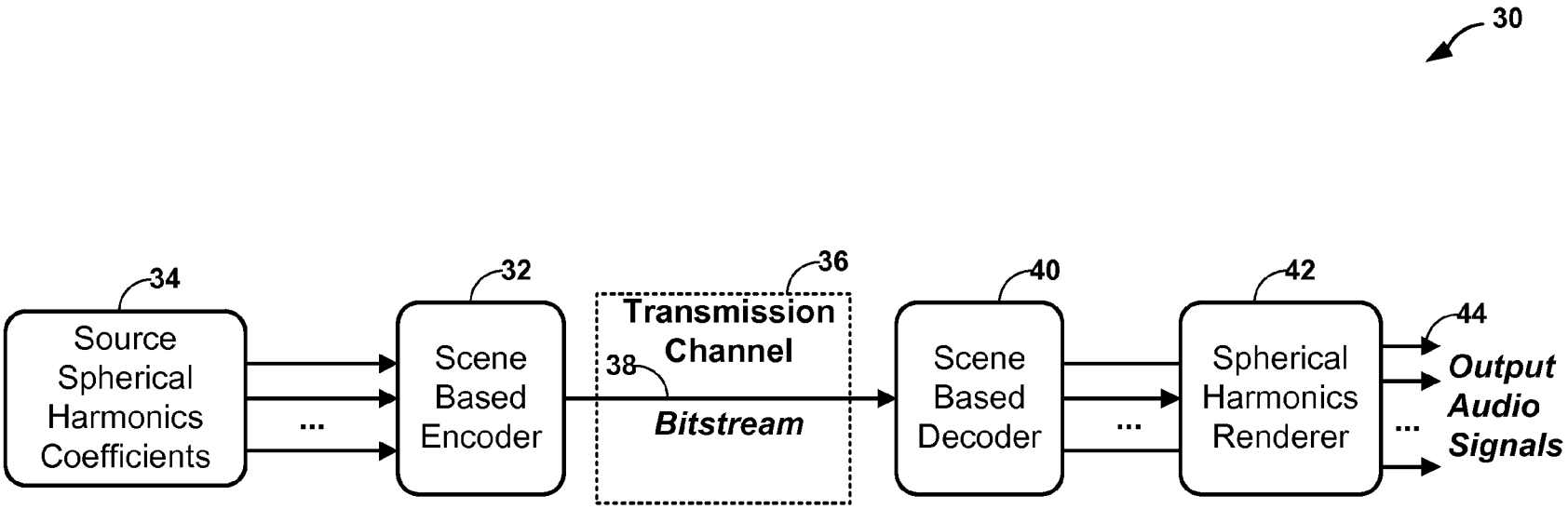
FIG. 3 is a diagram illustrating an example of scene-based coding without consideration of backward compatibility.

FIG. 3 is a block diagram illustrating a system 30 that performs an encoding and decoding process with a scene-based spherical harmonic approach in accordance with aspects of the techniques described in this disclosure. In this example, encoder 32 produces a description of source spherical harmonic coefficients 34 ("SHC 34") that is transmitted (and/or stored) and decoded at decoder 40 (shown as "scene based decoder 40") to receive SHC 34 for rendering. Such encoding may include one or more lossy or lossless coding processes, such as quantization (e.g., into one or more codebook indices), error correction coding, redundancy coding, etc. Additionally or alternatively, such encoding may include encoding into an Ambisonic format, such as B-format, G-format, or Higher-order Ambisonics (HOA). In general, encoder 32 may encode the SHC 34 using known techniques that take advantage of redundancies and irrelevancies (for either lossy or lossless coding) to generate encoded SHC 38. Encoder 32 may transmit this encoded SHC 38 via transmission channel 36 often in the form of a bitstream (which may include the encoded SHC 38 along with other data that may be useful in decoding the encoded SHC 38). The decoder 40 may receive and decode the encoded SHC 38 to recover the SHC 34 or a slightly modified version thereof. The decoder 40 may output the recovered SHC 34 to spherical harmonics renderer 42, which may render the recovered SHC 34 as one or more output audio signals 44. Old receivers without the scene-based decoder 40 may be unable to decode such signals and, therefore, may not be able to play the program.

Figure 4:
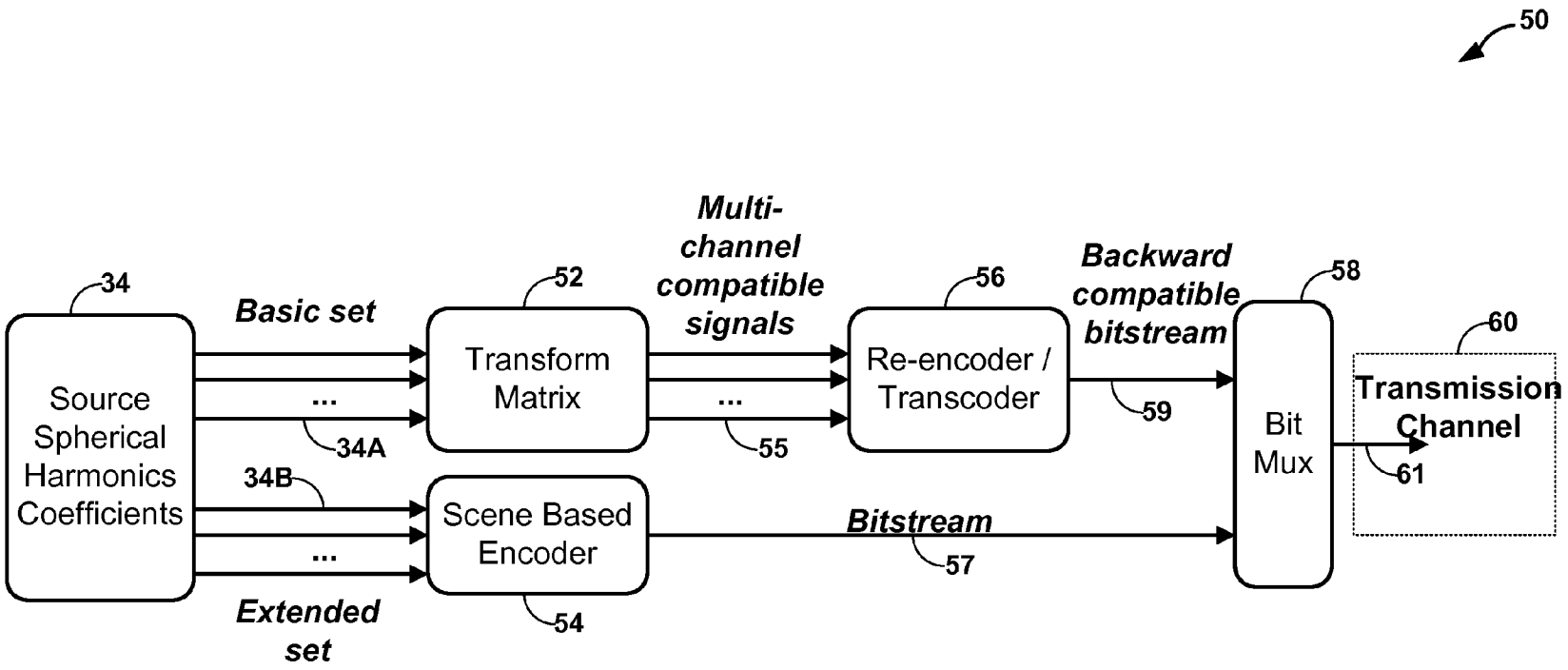
FIG. 4 is a diagram illustrating an example of an encoding process with a backward-compatible design.

FIG. 4 is a diagram illustrating an encoder 50 that may perform various aspects of the techniques described in this disclosure. The source SHC 34 (e.g., the same as shown in FIG. 3) may be the source signals mixed by mixing engineers in a scene-based-capable recording studio. The SHC 34 may also be captured by a microphone array, or a recording of a sonic presentation by surround speakers.

The encoder 50 may process two portions of the set of SHC 34 differently. The encoder 50 may apply transform matrix 52 to a basic set of the SHC 34 ("basic set 34A") to generate compatible multichannel signals 55. The re-encoder/transcoder 56 may then encode these signals 55 (which may be in a frequency domain, such as the FFT domain, or in the time domain) into backward compatible coded signals 59 that describe the multichannel signals. Compatible coders could include examples such as AC3 (also called ATSC A/52 or Dolby Digital), Dolby TrueHD, DTS-HD Master Audio, MPEG Surround. It is also possible for such an implementation to include two or more different transcoders, each coding the multichannel signal into a different respective format (e.g., an AC3 transcoder and a Dolby TrueHD transcoder), to produce two different backward compatible bitstreams for transmission and/or storage. Alternatively, the coding could be left out completely to just output multichannel audio signals as, e.g., a set of linear PCM streams (which is supported by HDMI standards).

The remaining one of the SHC 34 may represent an extended set of SHC 34 ("extended set 34B"). The encoder 50 may invoke scene based encoder 54 to encode the basic set 34B, which generates bitstream 57. The encoder 50 may then invoke bit multiplexer 58 ("bit mux 58") to multiplex backward compatible bitstream 59 and bitstream 57. The encoder 50 may then send this multiplexed bitstream 61 via the transmission channel (e.g., a wired and/or wireless channel).

Figure 5:
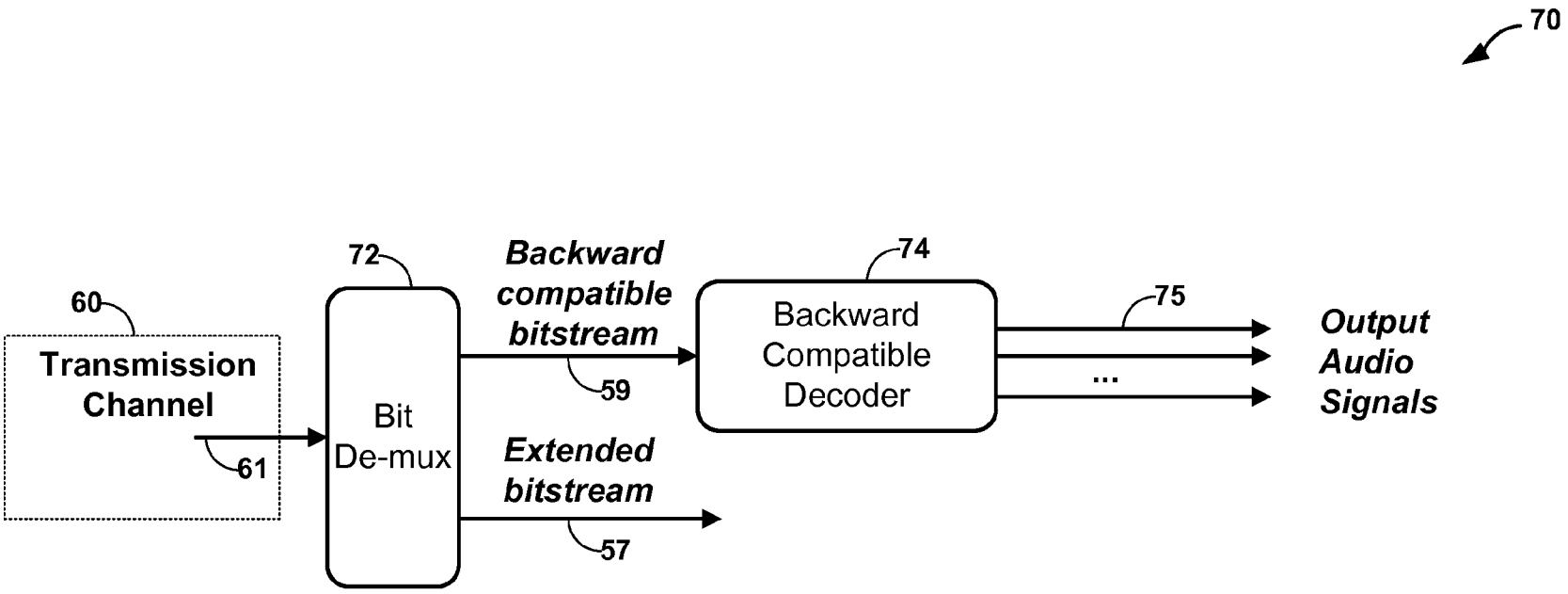
FIG. 5 is a diagram illustrating an example of a decoding process on a conventional decoder that cannot decode scene-based data.

FIG. 5 is a diagram illustrating a standard decoder 70 that supports only standard non-scene based decoding, but that is able to recover the backward compatible bitstream 59 formed in accordance with the techniques described in this disclosure. In other words, at the decoder 70, if the receiver is old and only supports conventional decoders, the decoder will take only the backward compatible bitstream 59 and discard the extended bitstream 57, as shown in FIG. 5. In operation, the decoder 70 receives the multiplexed bitstream 61 and invokes bit de-multiplexer ("bit de-mux 72"). The bit de-multiplexer 72 de-multiplexes multiplexed bitstream 61 to recover the backward compatible bitstream 59 and the extended bitstream 57. The decoder 70 then invokes backward compatible decoder 74 to decode backward compatible bitstream 59 and thereby generate output audio signals 75.

Figure 6:
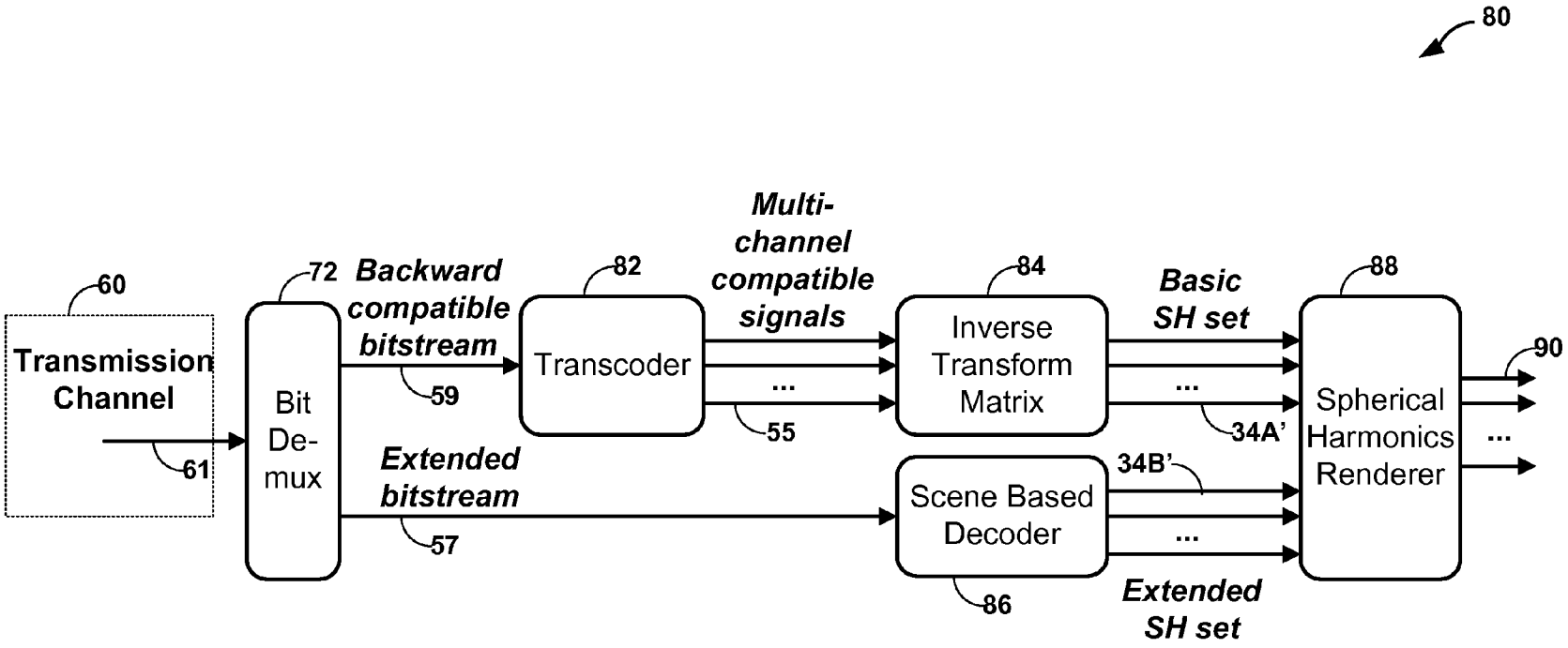
FIG. 6 is a diagram illustrating an example of a decoding process with a device that can handle scene-based data.

FIG. 6 is a diagram illustrating another decoder 80 that may perform various aspects of the techniques described in this disclosure. When the receiver is new and supports scene-based decoding, the decoding process is shown in FIG. 6, which is a reciprocal process to the encoder of FIG. 4. Similar to the decoder 70, the decoder 80 includes a bit de-mux 72 that de-multiplexes multiplexed bitstream 61 to recover the backward compatible bitstream 59 and the extended bitstream 57. The decoder 80, however, may then invoke a transcoder 82 to transcode the backward compatible bitstream 59 and recover the multi-channel compatible signals 55. The decoder 80 may then apply an inverse transform matrix 84 to the multi-channel compatible signals 55 to recover the basic set 34A' (where the prime (') denotes that this basic set 34A' may be modified slightly in comparison to the basic set 34A). The decoder 80 may also invoke scene based decoder 86, which may decode the extended bitstream 57 to recover the extended set 34B' (where again the prime (') denotes that this extended set 34B' may be modified slightly in comparison to the extended set 34B). In any event, the decoder 80 may invoke a spherical harmonics renderer 88 to render the combination of the basic set 34A' and the extended set 34B' to generate output audio signals 90.

In other words, if applicable, a transcoder 82 converts the backward compatible bitstream 59 into multichannel signals 55. Subsequently these multichannel signals 55 are processed by an inverse matrix 84 to recover the basic set 34A'. The extended set 34B' is recovered by a scene-based decoder 86. The complete set of SHC 34' are combined and processed by the SH renderer 88.

Design of such an implementation may include selecting the subset of the original hierarchical set that is to be converted to multichannel audio (e.g., to a conventional format). Another issue that may arise is how much error is produced in the forward and backward conversion from the basic set (e.g., of SHC) to multichannel audio and back to the basic set.

Various solutions to the above are possible. In the discussions below, 5.1 format will be used as a typical target multichannel audio format, and an example approach will be elaborated. The methodology can be generalized to other multichannel audio formats.

Since five signals (corresponding to full-band audio from specified locations) are available in the 5.1 format (plus the LFE signal—which has no standardized location and can be determined by lowpass filtering the five channels), one approach is to use five of the SHC to convert to the 5.1 format. Further, since the 5.1 format is only capable of 2D rendering, it may be desirable to only use SHC which carry some horizontal information. For example, the coefficient $A_1^0(k)$ carries very little information on horizontal directivity and can thus be excluded from this subset. The same is true for either the real or imaginary part of $A_2^1(k)$. Some of these vary depending on the definition of the Spherical Harmonics basis functions chosen in the implementation (there are various definitions in the literature—real, imaginary, complex or combinations). In this manner, five $A_n^m(k)$ coefficients can be picked for conversion. As the coefficient $A_0^0(k)$ carries the omnidirectional information, it may be desirable to always use this coefficient. Similarly, it may be desirable to include the real part of $A_1^1(k)$ and the imaginary part of $A_1^{-1}(k)$, as they carry significant horizontal directivity information. For the last two coefficients, possible candidates include the real and imaginary part of $A_2^2(k)$. Various other combinations are also possible. For example, the basic set may be selected to include only the three coefficients $A_0^0(k)$, the real part of $A_1^1(k)$, and the imaginary part of $A_1^{-1}(k)$.

The next step is to determine an invertible matrix that can convert between the basic set of SHC (e.g., the five coefficients as selected above) and the five full-band audio signals in the 5.1 format. The desire for invertibility is to allow conversion of the five full-band audio signals back to the basic set of SHC with little or no loss of resolution.

One possible method to determine this matrix is an operation known as 'mode-matching'. Here, the loudspeaker feeds are computed by assuming that each loudspeaker produces a spherical wave. In such a scenario, the pressure (as a function of frequency) at a certain position r, θ, ϕ, due to the l-th loudspeaker, is given by $$P_l(\omega, r, \theta, \varphi) = g_l(\omega)\sum_{n=0}^{\infty} j_n(kr)\sum_{m=-n}^{n}(-4\pi ik)h_n^{(2)}(kr_l)Y_n^{m*}(\theta_l, \varphi_l)Y_n^m(\theta, \varphi),$$

where $\{r_l, \theta_l, \phi_l\}$ represents the position of the f-th loudspeaker and $g_l(\omega)$ is the loudspeaker feed of the l-th speaker (in the frequency domain). The total pressure $P_t$ due to all five speakers is thus given by $$P_t(\omega, r, \theta, \varphi) = \sum_{l=1}^{5} g_l(\omega) \sum_{n=0}^{\infty} j_n(kr) \sum_{m=-n}^{n} (-4\pi ik) h_n^{(2)}(kr_l) Y_n^{m*}(\theta_l, \varphi_l) Y_n^m(\theta, \varphi).$$

We also know that the total pressure in terms of the five SHC is given by the equation $$P_t(\omega, r, \theta, \varphi) = 4\pi \sum_{n=0}^{\infty} j_n(kr) \sum_{m=-n}^{n} A_n^m(k) Y_n^m(\theta, \varphi)$$

Equating the above two equations allows us to use a transform matrix to express the loudspeaker feeds in terms of the SHC as follows:

$$\begin{bmatrix} A_0^0(\omega) \\ A_1^1(\omega) \\ A_1^{-1}(\omega) \\ A_2^2(\omega) \\ A_2^{-2}(\omega) \end{bmatrix} = -ik \begin{bmatrix} h_0^{(2)}(kr_1) Y_0^{0*}(\theta_1, \varphi_1) & h_0^{(2)}(kr_2) Y_0^{0*}(\theta_2, \varphi_2) & \dots & \dots & \dots \\ h_1^{(2)}(kr_1) Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix} \begin{bmatrix} g_1(\omega) \\ g_2(\omega) \\ g_3(\omega) \\ g_4(\omega) \\ g_5(\omega) \end{bmatrix}.$$

This expression shows that there is a direct relationship between the five loudspeaker feeds and the chosen SHC. The transform matrix may vary depending on, for example, which SHC were used in the subset (e.g., the basic set) and which definition of SH basis function is used. In a similar manner, a transform matrix to convert from a selected basic set to a different channel format (e.g., 7.1, 22.2) may be constructed While the transform matrix in the above expression allows a conversion from speaker feeds to the SHC, we would like the matrix to be invertible such that, starting with SHC, we can work out the five channel feeds and then, at the decoder, we can optionally convert back to the SHC (when advanced (i.e., non-legacy) renderers are present).

Various ways of manipulating the above framework to ensure invertibility of the matrix can be exploited. These include but are not limited to varying the position of the loudspeakers (e.g., adjusting the positions of one or more of the five loudspeakers of a 5.1 system such that they still adhere to the angular tolerance specified by the ITU-R BS.775-1 standard; regular spacings of the transducers, such as those adhering to the T-design, are typically well behaved), regularization techniques (e.g., frequency-dependent regularization) and various other matrix manipulation techniques that often work to ensure full rank and well-defined eigenvalues. Finally, it may be desirable to test the 5.1 rendition psycho-acoustically to ensure that after all the manipulation, the modified matrix does indeed produce correct and/or acceptable loudspeaker feeds. As long as invertibility is preserved, the inverse problem of ensuring correct decoding to the SHC is not an issue.

For some local speaker geometries (which may refer to a speaker geometry at the decoder), the way outlined above to manipulate the above framework to ensure invertibility may result in less-than-desirable audio-image quality. That is, the sound reproduction may not always result in a correct localization of sounds when compared to the audio being captured. In order to correct for this less-than-desirable image quality, the techniques may be further augmented to introduce a concept that may be referred to as "virtual speakers." Rather than require that one or more loudspeakers be repositioned or positioned in particular or defined regions of space having certain angular tolerances specified by a standard, such as the above noted ITU-R BS.775-1, the above framework may be modified to include some form of panning, such as vector base amplitude panning (VBAP), distance based amplitude panning, or other forms of panning Focusing on VBAP for purposes of illustration, VBAP may effectively introduce what may be characterized as "virtual speakers." VBAP may generally modify a feed to one or more loudspeakers so that these one or more loudspeakers effectively output sound that appears to originate from a virtual speaker at one or more of a location and angle different than at least one of the location and/or angle of the one or more loudspeakers that supports the virtual speaker.

To illustrate, the above equation for determining the loudspeaker feeds in terms of the SHC may be modified as follows:

$$\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix} = -ik \begin{bmatrix} VBAP \\ \text{MATRIX} \\ M \times N \end{bmatrix} \begin{bmatrix} D \\ N \times (\text{Order}+1)^2 \end{bmatrix} \begin{bmatrix} g_1(\omega) \\ g_2(\omega) \\ g_3(\omega) \\ \dots \\ g_M(\omega) \end{bmatrix}.$$

In the above equation, the VBAP matrix is of size M rows by N columns, where M denotes the number of speakers (and would be equal to five in the equation above) and N denotes the number of virtual speakers. The VBAP matrix may be computed as a function of the vectors from the defined location of the listener to each of the positions of the speakers and the vectors from the defined location of the listener to each of the positions of the virtual speakers. The D matrix in the above equation may be of size N rows by $(\text{order}+1)^2$ columns, where the order may refer to the order of the SH functions. The D matrix may represent the following $$\text{matrix} \begin{bmatrix} h_0^{(2)}(kr_1) Y_0^{0*}(\theta_1, \varphi_1) & h_0^{(2)}(kr_2) Y_0^{0*}(\theta_2, \varphi_2) & \dots & \dots & \dots \\ h_1^{(2)}(kr_1) Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix}.$$

In effect, the VBAP matrix is an M×N matrix providing what may be referred to as a "gain adjustment" that factors in the location of the speakers and the position of the virtual speakers. Introducing panning in this manner may result in better reproduction of the multi-channel audio that results in a better quality image when reproduced by the local speaker geometry. Moreover, by incorporating VBAP into this equation, the techniques may overcome poor speaker geometries that do not align with those specified in various standards.

In practice, the equation may be inverted and employed to transform SHC back to a multi-channel feed for a particular geometry or configuration of loudspeakers, which may be referred to as geometry B below. That is, the equation may be inverted to solve for the g matrix. The inverted equation may be as follows:

$$\begin{bmatrix} g_1(\omega) \\ g_2(\omega) \\ g_3(\omega) \\ \cdots \\ g_M(\omega) \end{bmatrix} = -ik \begin{bmatrix} VBAP^{-1} \\ \text{MATRIX}^{-1} \\ M \times N \end{bmatrix} \begin{bmatrix} D^{-1} \\ N \times (\text{Order}+1)^2 \end{bmatrix} \begin{bmatrix} A_0^0(\omega) \\ A_1^1(\omega) \\ A_1^{-1}(\omega) \\ \cdots \\ A_{(Order+1)(Order+1)}^{-(Order+1)(Order+1)}(\omega) \end{bmatrix}.$$

The g matrix may represent speaker gain for, in this example, each of the five loudspeakers in a 5.1 speaker configuration. The virtual speakers locations used in this configuration may correspond to the locations defined in a 5.1 multichannel format specification or standard. The location of the loudspeakers that may support each of these virtual speakers may be determined using any number of known audio localization techniques, many of which involve playing a tone having a particular frequency to determine a location of each loudspeaker with respect to a headend unit (such as an audio/video receiver (A/V receiver), television, gaming system, digital video disc system, or other types of headend systems). Alternatively, a user of the headend unit may manually specify the location of each of the loudspeakers. In any event, given these known locations and possible angles, the headend unit may solve for the gains, assuming an ideal configuration of virtual loudspeakers by way of VBAP.

In this respect, the techniques may enable a device or apparatus to perform a vector base amplitude panning or other form of panning on the first plurality of loudspeaker channel signals to produce a first plurality of virtual loudspeaker channel signals. These virtual loudspeaker channel signals may represent signals provided to the loudspeakers that enable these loudspeakers to produce sounds that appear to originate from the virtual loudspeakers. As a result, when performing the first transform on the first plurality of loudspeaker channel signals, the techniques may enable a device or apparatus to perform the first transform on the first plurality of virtual loudspeaker channel signals to produce the hierarchical set of elements that describes the sound field.

Moreover, the techniques may enable an apparatus to perform a second transform on the hierarchical set of elements to produce a second plurality of loudspeaker channel signals, where each of the second plurality of loudspeaker channel signals is associated with a corresponding different region of space, where the second plurality of loudspeaker channel signals comprise a second plurality of virtual loudspeaker channels and where the second plurality of virtual loudspeaker channel signals is associated with the corresponding different region of space. The techniques may, in some instances, enable a device to perform a vector base amplitude panning on the second plurality of virtual loudspeaker channel signals to produce a second plurality of loudspeaker channel signals.

While the above transformation matrix was derived from a 'mode matching' criteria, alternative transform matrices can be derived from other criteria as well, such as pressure matching, energy matching, etc. It is sufficient that a matrix can be derived that allows the transformation between the basic set (e.g., SHC subset) and traditional multichannel audio and also that after manipulation (that does not reduce the fidelity of the multichannel audio), a slightly modified matrix can also be formulated that is also invertible.

The above section discussed the design for 5.1 compatible systems. The details may be adjusted accordingly for different target formats. As an example, to enable compatibility for 7.1 systems, two extra audio content channels are added to the compatible requirement, and two more SHC may be added to the basic set, so that the matrix is invertible. Since the majority loudspeaker arrangement for 7.1 systems (e.g., Dolby TrueHD) are still on a horizontal plane, the selection of SHC can still exclude the ones with height information. In this way, horizontal plane signal rendering will benefit from the added loudspeaker channels in the rendering system. In a system that includes loudspeakers with height diversity (e.g., 9.1, 11.1 and 22.2 systems), it may be desirable to include SHC with height information in the basic set.

For a lower number of channels like stereo and mono, existing 5.1 solutions in many prior arts should be enough to cover the downmix to maintain the content information. These cases are considered trivial and not discussed further in this disclosure.

The above thus represents a lossless mechanism to convert between a hierarchical set of elements (e.g., a set of SHC) and multiple audio channels. No errors are incurred as long as the multichannel audio signals are not subjected to further coding noise. In case they are subjected to coding noise, the conversion to SHC may incur errors. However, it is possible to account for these errors by monitoring the values of the coefficients and taking appropriate action to reduce their effect. These methods may take into account characteristics of the SHC, including the inherent redundancy in the SHC representation.

While we have generalized to multichannels, the main emphasis in the current marketplace is for 5.1 channels, as that is the 'least common denominator' to ensure functionality of legacy consumer audio systems such as set-top boxes.

The approach described herein provides a solution to a potential disadvantage in the use of SHC-based representation of sound fields. Without this solution, the SHC-based representation may never be deployed, due to the significant disadvantage imposed by not being able to have functionality in the millions of legacy playback systems.

Figure 7A:
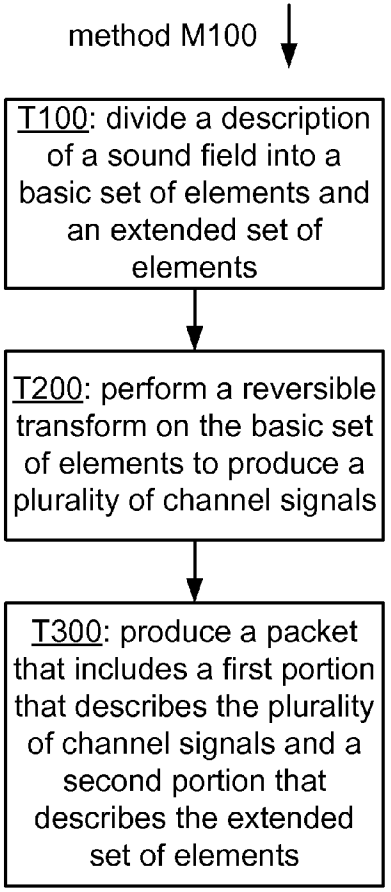
FIG. 7A is a flowchart illustrating a method of audio signal processing in accordance with various aspects of the techniques described in this disclosure.

FIG. 7A is a flowchart illustrating a method of audio signal processing M100 according to a general configuration that includes tasks T100, T200, and T300 consistent with various aspects the techniques described in this disclosure. Task T100 divides a description of a sound field (e.g., a set of SHC) into basic set of elements, e.g., the basic set 34A shown in the example of FIG. 4, and an extended set of elements, e.g., the extended set 34B. Task T200 performs a reversible transform, such as the transform matrix 52, on the basic set 34A to produce a plurality of channel signals 55, wherein each of the plurality of channel signals 55 is associated with a corresponding different region of space. Task T300 produces a packet that includes a first portion that describes the plurality of channel signals 55 and a second portion (e.g., an auxiliary data portion) that describes the extended set 34B.

Figure 7B:
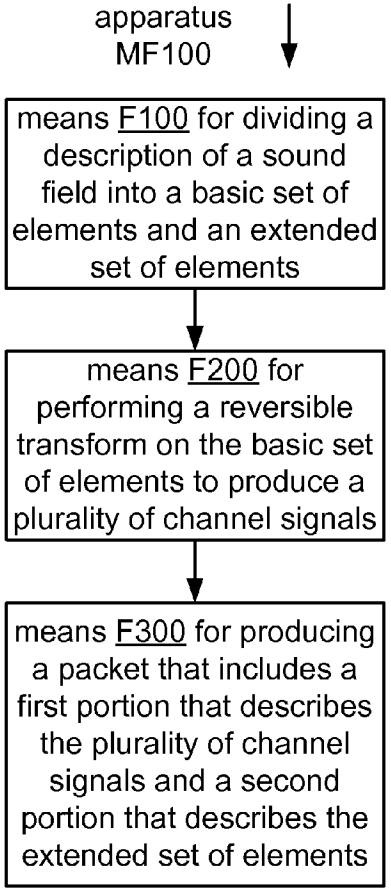
FIG. 7B is a block diagram illustrating an apparatus that performs various aspects of the techniques described in this disclosure.

FIG. 7B is a block diagram illustrating an apparatus MF100 according to a general configuration consistent with various aspects of the techniques described in this disclosure. Apparatus MF100 includes means F100 for producing a description of a sound field that includes a basic set of elements, e.g., the basic set 34A shown in the example of FIG. 4, and an extended set of elements 34B (as described herein, e.g. with reference to task T100). Apparatus MF100 also includes means F200 for performing a reversible transform, such as the transform matrix 52, on the basic set 34A to produce a plurality of channel signals 55, where each of the plurality of channel signals 55 is associated with a corresponding different region of space (as described herein, e.g. with reference to task T200). Apparatus MF100 also includes means F300 for producing a packet that includes a first portion that describes the plurality of channel signals 55 and a second portion that describes the extended set of elements 34B (as described herein, e.g. with reference to task T300).

Figure 7C:
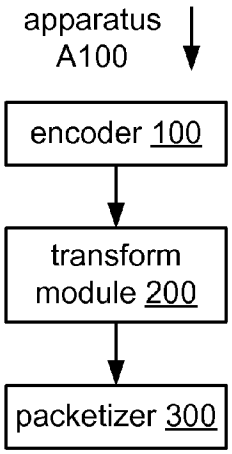
FIG. 7C is a block diagram illustrating an apparatus for audio signal processing according to another general configuration.

FIG. 7C is a block diagram of an apparatus A100 for audio signal processing according to another general configuration consistent with various aspects of the techniques described in this disclosure. Apparatus A100 includes an encoder 100 configured to produce a description of a sound field that includes a basic set of elements, e.g., the basic set 34A shown in the example of FIG. 4, and an extended set of elements 34B (as described herein, e.g. with reference to task T100). Apparatus A100 also includes a transform module 200 configured to perform a reversible transform, such as the transform matrix 52, on the basic set 34A to produce a plurality of channel signals 55, where each of the plurality of channel signals 55 is associated with a corresponding different region of space (as described herein, e.g. with reference to task T200). Apparatus A100 also includes a packetizer 300 configured to produce a packet that includes a first portion that describes the plurality of channel signals 55 and a second portion that describes the extended set of elements 34B (as described herein, e.g. with reference to task T300).

Figure 8B:
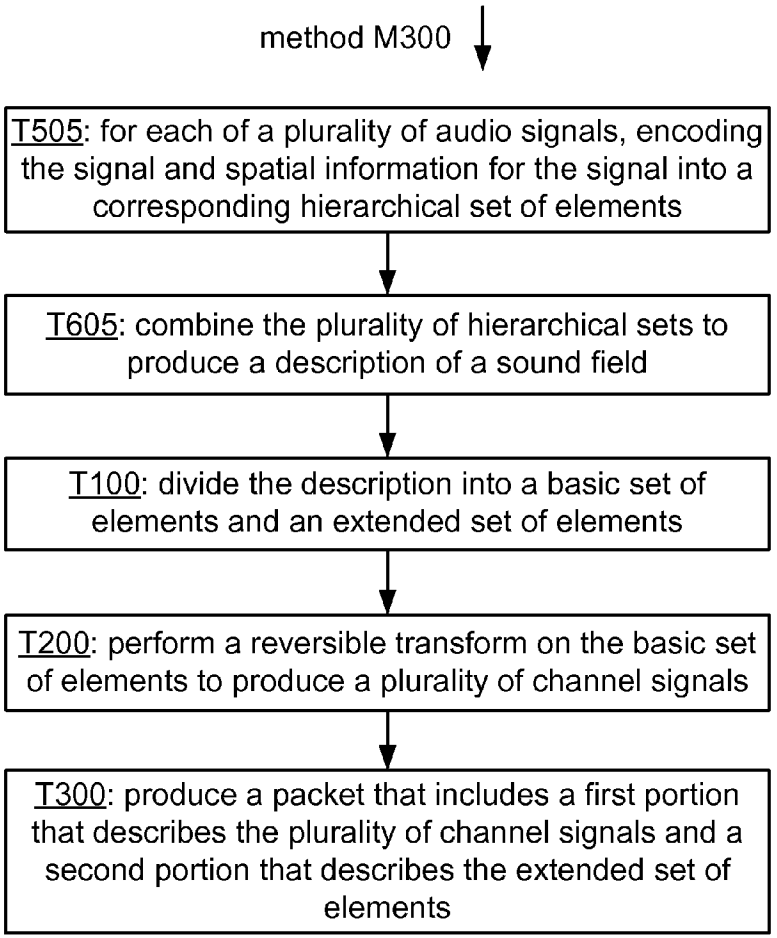
FIG. 8B is a flowchart illustrating an implementation of a method in accordance with various aspects of the techniques described in this disclosure.
Figure 8A:
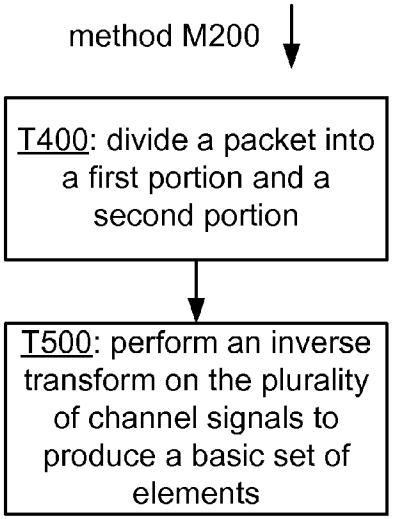
FIG. 8A is a flowchart illustrating a method of audio signal processing according to various aspects of the techniques described in this disclosure.

FIG. 8A is a flowchart illustrating a method of audio signal processing M100 according to a general configuration that includes tasks T400 and T500 that represents one example of the techniques described in this disclosure. Task T400 divides a packet into a first portion that describes a plurality of channel signals, such as signals 55 shown in the example of FIGS. 5 and 6, each associated with a corresponding different region of space, and a second portion that describes an extended set of elements, e.g., the basic set 34A shown in the example of FIG. 5. Task T500 performs an inverse transform, such as inverse transform matrix 84, on the plurality of channel signals 55 to recover a basic set of elements 34A'. In this method, the basic set 34A' comprises a lower-order portion of a hierarchical set of elements that describes a sound field (e.g., a set of SHC), and the extended set of elements 34B' comprises a higher-order portion of the hierarchical set.

FIG. 8B is a flowchart illustrating an implementation M300 of method M100 that includes tasks T505 and T605. For each of a plurality of audio signals (e.g., audio objects), task T505 encodes the signal and spatial information for the signal into a corresponding hierarchical set of elements that describe a sound field. Task T605 combines the plurality of hierarchical sets to produce a description of a sound field to be processed in task T100. For example, task T605 may be implemented to add the plurality of hierarchical sets (e.g., to perform coefficient vector addition) to produce a description of a combined sound field. The hierarchical set of elements (e.g., SHC vector) for one object may have a higher order (e.g., a longer length) than the hierarchical set of elements for another of the objects. For example, an object in the foreground (e.g., the voice of a leading actor) may be represented with a higher-order set than an object in the background (e.g., a sound effect).

Principles disclosed herein may also be used to implement systems, methods, and apparatus to compensate for differences in loudspeaker geometry in a channel-based audio scheme. For example, usually a professional audio engineer/artist mixes audio using loudspeakers in a certain geometry ("geometry A"). It may be desired to produce loudspeaker feeds for a certain alternate loudspeaker geometry ("geometry B"). Techniques disclosed herein (e.g., with reference to the transform matrix between the loudspeaker feeds and the SHC) may be used to convert the loudspeaker feeds from geometry A into SHC and then to re-render them into loudspeaker geometry B. In one example, geometry B is an arbitrary desired geometry. In another example, geometry B is a standardized geometry (e.g., as specified in a standards document, such as the ITU-R BS.775-1 standard). That is, this standardized geometry may define a location or region of space at which each speaker is to be located. These regions of space defined by a standard may be referred to as defined regions of space. Such an approach may be used to compensate for differences between geometries A and B not only in the distances (radii) of one or more of the loudspeakers relative to the listener, but also for differences in azimuth and/or elevation angle of one or more loudspeakers relative to the listener. Such a conversion may be performed at an encoder and/or at a decoder.

Figure 9A:
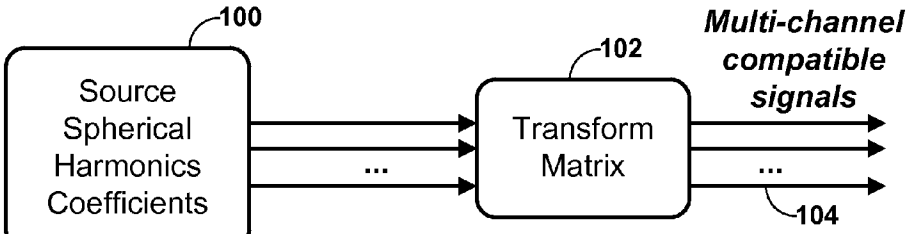
FIG. 9A is a diagram illustrating a conversion from SHC to multi-channel signals.

FIG. 9A is a diagram illustrating a conversion as described above from SHC 100 to multi-channel signals 104 compatible with a particular geometry through application of a transform matrix 102 according to various aspects of the techniques described in this disclosure.

Figure 9B:
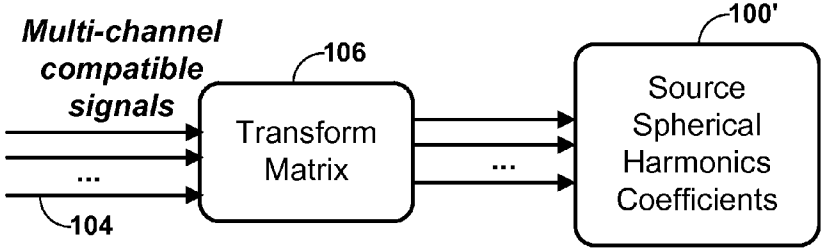
FIG. 9B is a diagram illustrating a conversion from multi-channel signals to SHC.

FIG. 9B is a diagram illustrating a conversion as described above from multi-channel signals 104 compatible with a particular geometry to recover SHC 100' through application of a transform matrix 106 (which may be an inverted form of transform matrix 102) according to various aspects of the techniques described in this disclosure.

Figure 9C:
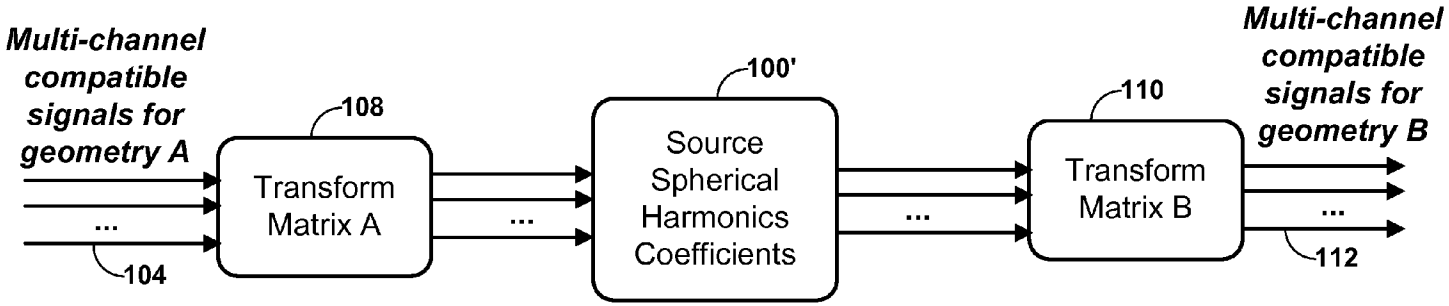
FIG. 9C is a diagram illustrating a first conversion from multi-channel signals compatible with a geometry A to SHC, and a second conversion from the SHC to multi-channel signals compatible with a geometry B.

FIG. 9C is a diagram illustrating a first conversion, through application of transform matrix A 108 as described above, from multi-channel signals 104 compatible with a geometry A to recover SHC 100', and a second conversion from the SHC 100' to multi-channel signals 112 compatible with a geometry B through application of a transform matrix 110 according to various aspects of the techniques described in this disclosure. It is noted that an implementation as illustrated in FIG. 9C may be extended to include one or more additional conversions from the SHC to multi-channel signals compatible with other geometries.

In a basic case, the number of channels in geometries A and B are the same. It is noted that for such geometry conversion applications, it may be possible to relax the constraints described above to ensure invertibility of the transform matrix. Further implementations include systems, methods, and apparatus in which the number of channels in geometry A is more or less than the number of channels in geometry B.

Figure 10A:
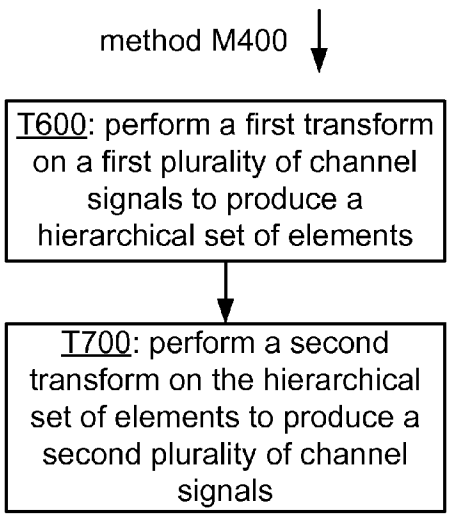
FIG. 10A is a flowchart illustrating a method of audio signal processing M400 according to a general configuration.

FIG. 10A is a flowchart illustrating a method of audio signal processing M400 according to a general configuration that includes tasks T600 and T700 consistent with various aspects of the techniques described in this disclosure. Task T600 performs a first transform, e.g., transform matrix A 108 shown in FIG. 9C, on a first plurality of channel signals, e.g., signals 104, where each of the first plurality of channel signals 104 is associated with a corresponding different region of space, to produce a hierarchical set of elements, e.g., the recovered SHC 100', that describes a sound field (e.g., as described with reference to FIGS. 9B and 9C). Task T700 performs a second transform, e.g., transform matrix 110, on the hierarchical set of elements 100' to produce a second plurality of channel signals 112, where each of the second plurality of channel signals 112 is associated with a corresponding different region of space (e.g., as described herein with reference to task T200 and FIGS. 4, 9A, and 9C).

Figure 10B:
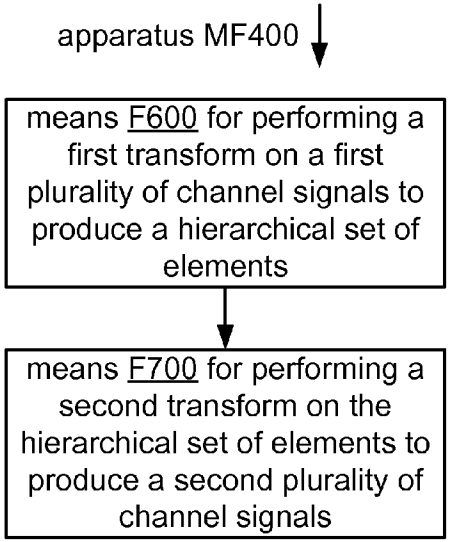
FIG. 10B is a block diagram illustrating an apparatus for audio signal processing MF400 according to a general configuration.

FIG. 10B is a block diagram illustrating an apparatus for audio signal processing MF400 according to a general configuration. Apparatus MF400 includes means F600 for performing a first transform, e.g., transform matrix A 108 shown in the example of FIG. 9C, on a first plurality of channel signals, e.g., signals 104, where each of the first plurality of channel signals 104 is associated with a corresponding different region of space, to produce a hierarchical set of elements, e.g., the recovered SHC 100', that describes a sound field (as described herein, e.g., with reference to task T600). Apparatus MF100 also includes means F700 for performing a second transform, e.g., transform matrix B 110, on the hierarchical set of elements 100' to produce a second plurality of channel signals 112, where each of the second plurality of channel signals 112 is associated with a corresponding different region of space (as described herein, e.g., with reference to tasks T200 and T700).

Figure 10C:
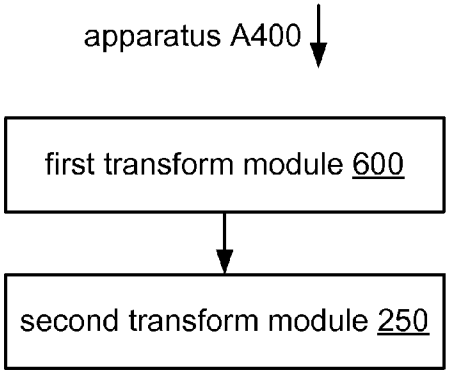
FIG. 10C is a block diagram illustrating an apparatus for audio signal processing A400 according to another general configuration.

FIG. 10C is a block diagram illustrating an apparatus for audio signal processing A400 according to another general configuration consistent with the techniques described in this disclosure. Apparatus A400 includes a first transform module 600 configured to perform a first transform, e.g., transform matrix A 108, on a first plurality of channel signals, e.g., signals 104, where each of the first plurality of channel signals 104 is associated with a corresponding different region of space, to produce a hierarchical set of elements, e.g., the recovered SHC 100', that describes a sound field (as described herein, e.g., with reference to task T600). Apparatus A100 also includes a second transform module 250 configured to perform a second transform, e.g., the transform matrix B 110, on the hierarchical set of elements 100' to produce a second plurality of channel signals 112, where each of the second plurality of channel signals 112 is associated with a corresponding different region of space (as described herein, e.g., with reference to tasks T200 and T600). Second transform module 250 may be realized, for example, as an implementation of transform module 200.

Figure 10D:
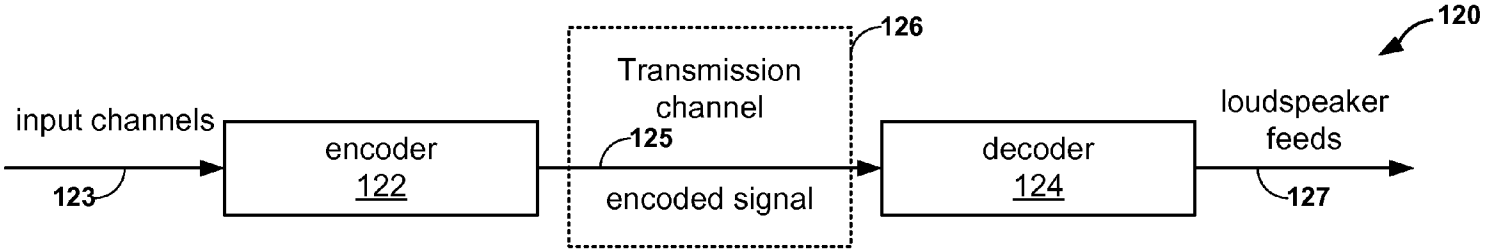
FIG. 10D is a diagram illustrating an example of a system that performs various aspects of the techniques described in this disclosure.

FIG. 10D is a diagram illustrating an example of a system 120 that includes an encoder 122 that receives input channels 123 (e.g., a set of PCM streams, each corresponding to a different channel) and produces a corresponding encoded signal 125 for transmission via a transmission channel 126 (and/or, although not shown for ease of illustration purposes, storage to a storage medium, such as a DVD disk). This system 120 also includes a decoder 124 that receives the encoded signal 125 and produces a corresponding set of loudspeaker feeds 127 according to a particular loudspeaker geometry. In one example, encoder 122 is implemented to perform a procedure as illustrated in FIG. 9C, where the input channels correspond to geometry A and the encoded signal 125 describes a multichannel signal that corresponds to geometry B. In another example, decoder 124 has knowledge of geometry A and is implemented to perform a procedure as illustrated in FIG. 9C.

Figure 11A:
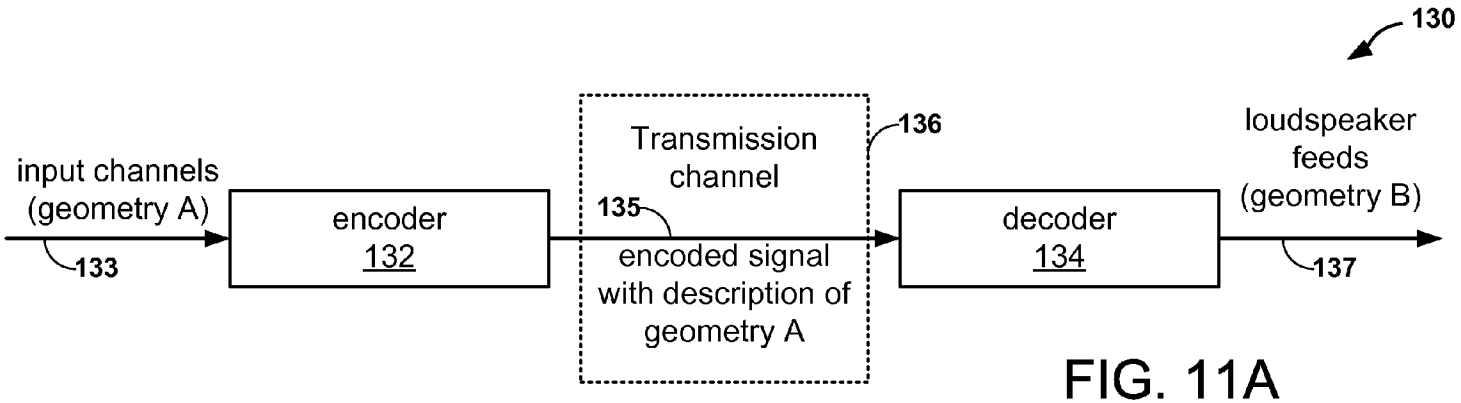
FIG. 11A is a diagram illustrating an example of another system that performs various aspects of the techniques described in this disclosure.

FIG. 11A is a diagram illustration an example of another system 130 that includes encoder 132 that receives a set of input channels 133 that corresponds to a geometry A and produces a corresponding encoded signal 135 for transmission via a transmission channel 136 (and/or for storage to a storage medium, such as a DVD disk), together with a description of the corresponding geometry A (e.g., of the coordinates of the loudspeakers in space). This system 130 also includes decoder 134 that receives the encoded signal 135 and geometry A description and produces a corresponding set of loudspeaker feeds 137 according to a different loudspeaker geometry B.

Figure 11B:
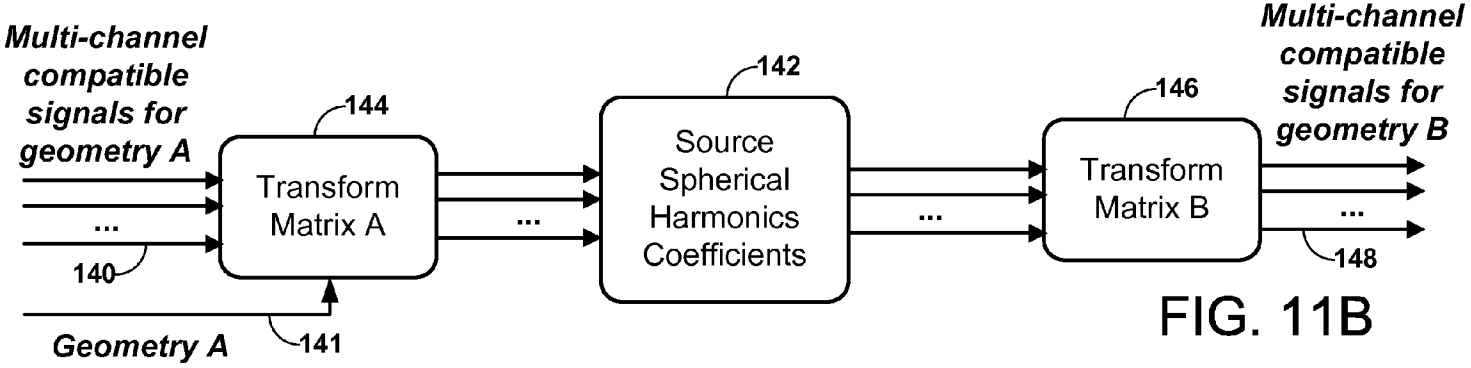
FIG. 11B is a diagram illustrating a sequence of operations that may be performed by decoder.

FIG. 11B is a diagram illustration a sequence of operations that may be performed by decoder 134, with a first conversion (through application of transform matrix A 144 as described above) from multi-channel signals 140 to SHC 142, the conversion being adaptive (e.g., by a corresponding implementation of first transform module 600) according to the description 141 of geometry A, and a second conversion (through application of a transform matrix B 146) from the SHC 142 to multi-channel signals 148 compatible with geometry B. The second conversion may be fixed for a particular geometry B or may also be adaptive according to a description (not shown in the example of FIG. 11B for ease of illustration purposes) of the desired geometry B (e.g., as provided to a corresponding implementation of second transform module 250).

Figure 12B:
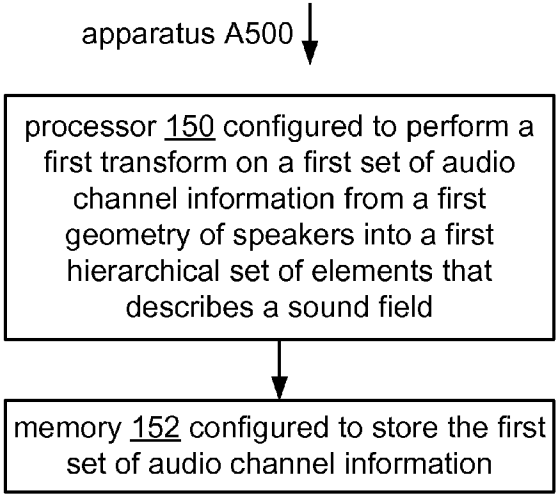
FIG. 12B is a block diagram illustrating an apparatus according to a general configuration.
Figure 12A:
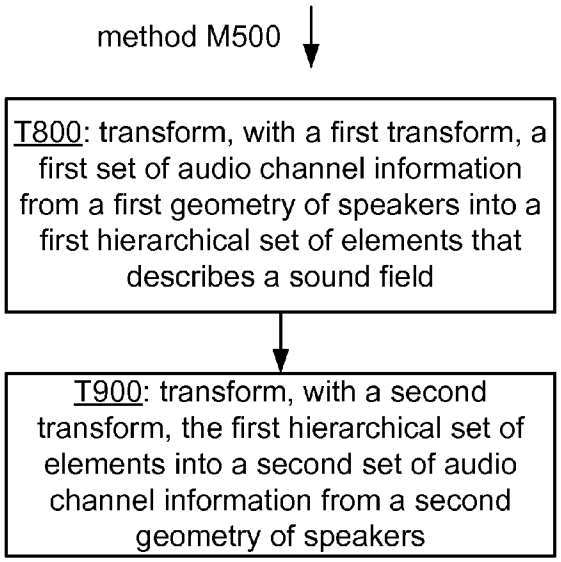
FIG. 12A is a flowchart illustrating a method of audio signal processing according to a general configuration.

FIG. 12A is a flowchart illustrating a method of audio signal processing M500 according to a general configuration that includes tasks T800 and T900. Task T800 transforms, with a first transform (such as the transform matrix A 144 shown in the example of FIG. 11B), a first set of audio channel information, e.g., signals 140, from a first geometry of speakers into a first hierarchical set of elements, e.g., SHC 142, that describes a sound field. Task T900 transforms, with a second transform (such as the transform matrix B 146), the first hierarchical set of elements 144 into a second set of audio channel information 148 for a second geometry of speakers. The first and second geometries may have, for example, different radii, azimuth, and/or elevation angle.

FIG. 12B is a block diagram illustrating an apparatus A500 according to a general configuration. Apparatus A500 includes a processor 150 configured to perform a first transform, such as the transform matrix A 144 shown in the example of FIG. 11B, on a first set of audio channel information, e.g., signals 140, from a first geometry of speakers into a first hierarchical set of elements, e.g., the SHC 144, that describes a sound field. Apparatus A500 also includes a memory 152 configured to store the first set of audio channel information.

Figure 12D:
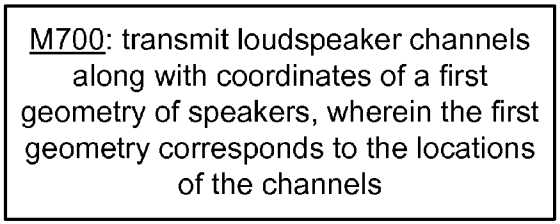
FIG. 12D is a flowchart illustrating a method of audio signal processing according to a general configuration.
Figure 12C:
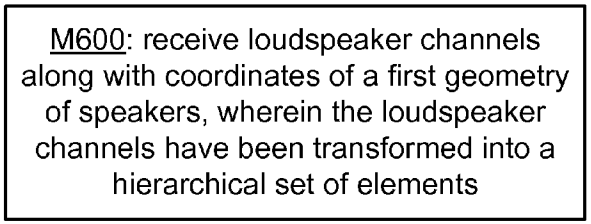
FIG. 12C is a flowchart illustrating a method of audio signal processing according to a general configuration.

FIG. 12C is a flowchart illustrating a method of audio signal processing M600 according to a general configuration that receives loudspeaker channels, e.g., the signals 140 shown in the example of FIG. 11B, along with coordinates of a first geometry of speakers, e.g., the description 141, where the loudspeaker channels have been transformed into a hierarchical set of elements, e.g., the SHC 144.

FIG. 12D is a flowchart illustrating a method of audio signal processing M700 according to a general configuration that transmits loudspeaker channels, e.g., the signals 140 shown in the example of FIG. 11B, along with coordinates of a first geometry of speakers, e.g., the description 141, where the first geometry corresponds to the locations of the channels.

Figure 13A:
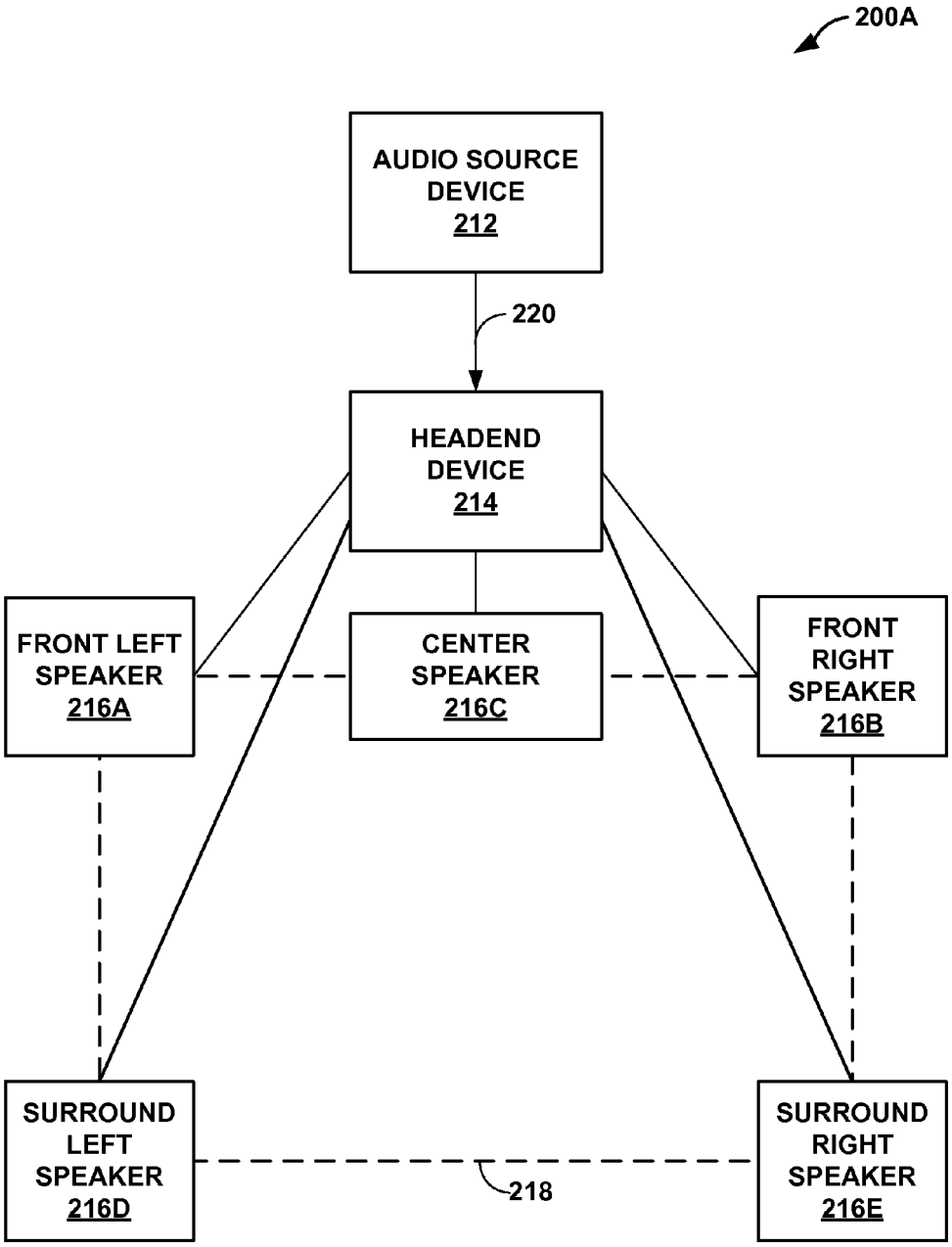
FIGS. 13A-13C are block diagrams illustrating example audio playback systems that may perform various aspects of the techniques described in this disclosure.
Figure 13B:
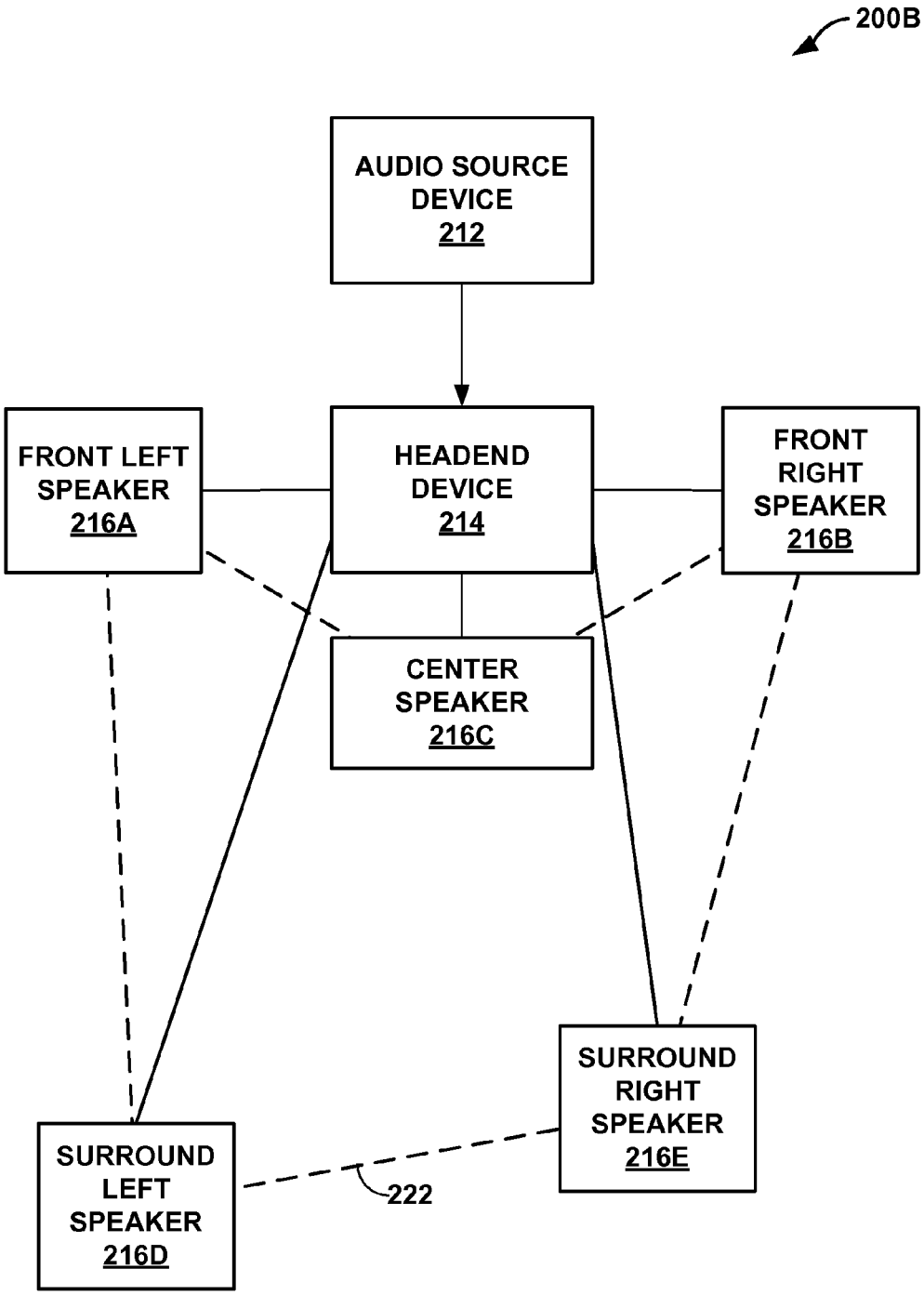
Figure 13C:
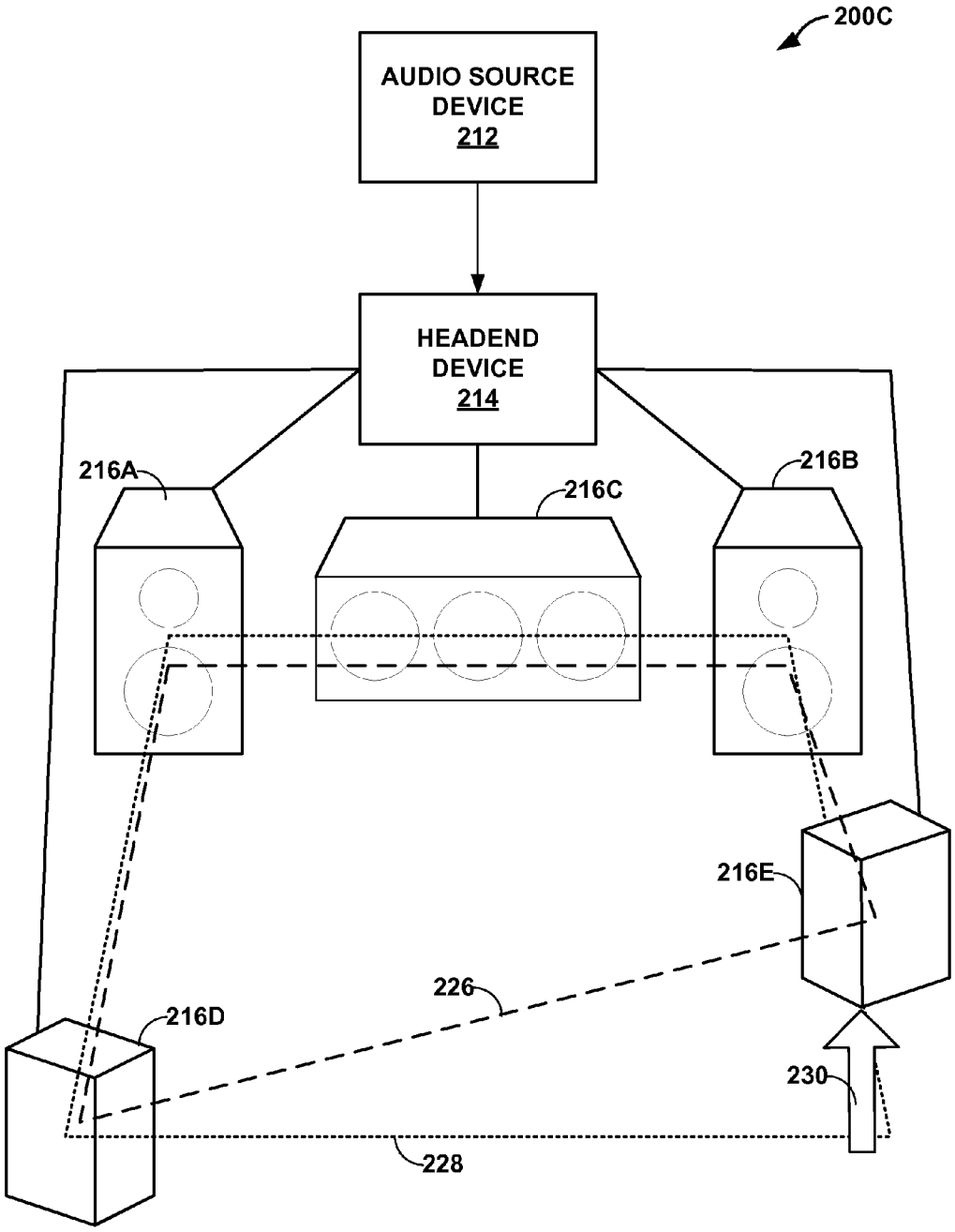

FIGS. 13A-13C are block diagrams illustrating example audio playback systems 200A-200C that may perform various aspects of the techniques described in this disclosure. In the example of FIG. 13A, the audio playback system 200A includes an audio source device 212, a headend device 214, a front left speaker 216A, a front right speaker 216B, a center speaker 216C, a left surround sound speaker 216D and a right surround sound speaker 216E. While shown as including dedicated speakers 216A-216E ("speakers 216"), the techniques may be performed in instances where other devices that include speakers are used in place of dedicated speakers 216.

The audio source device 212 may represent any type of device capable of generating source audio data. For example, the audio source device 212 may represent a television set (including so-called "smart televisions" or "smarTVs" that feature Internet access and/or that execute an operating system capable of supporting execution of applications), a digital set top box (STB), a digital video disc (DVD) player, a high-definition disc player, a gaming system, a multimedia player, a streaming multimedia player, a record player, a desktop computer, a laptop computer, a tablet or slate computer, a cellular phone (including so-called "smart phones), or any other type of device or component capable of generating or otherwise providing source audio data. In some instances, the audio source device 212 may include a display, such as in the instance where the audio source device 212 represents a television, desktop computer, laptop computer, tablet or slate computer, or cellular phone.

The headend device 214 represents any device capable of processing (or, in other words, rendering) the source audio data generated or otherwise provided by the audio source device 212. In some instances, the headend device 214 may be integrated with the audio source device 212 to form a single device, e.g., such that the audio source device 212 is inside or part of the headend device 214. To illustrate, when the audio source device 212 represents a television, desktop computer, laptop computer, slate or tablet computer, gaming system, mobile phone, or high-definition disc player to provide a few examples, the audio source device 212 may be integrated with the headend device 214. That is, the headend device 214 may be any of a variety of devices such as a television, desktop computer, laptop computer, slate or tablet computer, gaming system, cellular phone, or high-definition disc player, or the like. The headend device 214, when not integrated with the audio source device 212, may represent an audio/video receiver (which is commonly referred to as a "A/V receiver") that provides a number of interfaces by which to communicate either via wired or wireless connection with the audio source device 212 and the speakers 216.

Each of speakers 216 may represent loudspeakers having one or more transducers. Typically, the front left speaker 216A is similar to or nearly the same as the front right speaker 216B, while the surround left speakers 216D is similar to or nearly the same as the surround right speaker 216E. The speakers 216 may provide for a wired and/or, in some instances wireless interfaces by which to communicate with the headend device 214. The speakers 216 may be actively powered or passively powered, where, when passively powered, the headend device 214 may drive each of the speakers 216.

In a typical multi-channel sound system (which may also be referred to as a "multi-channel surround sound system" or "surround sound system"), the A/V receiver, which may represent one example of the headend device 214, processes the source audio data to accommodate the placement of dedicated front left, front center, front right, back left (which may also be referred to as "surround left") and back right (which may also be referred to as "surround right") speakers 216. The A/V receiver often provides for a dedicated wired connection to each of these speakers so as to provide better audio quality, power the speakers and reduce interference. The A/V receiver may be configured to provide the appropriate channel to the appropriate one of speakers 216.

A number of different surround sound formats exist to replicate a stage or area of sound and thereby better present a more immersive sound experience. In a 5.1 surround sound system, the A/V receiver renders five channels of audio that include a center channel, a left channel, a right channel, a rear right channel and a rear left channel. An additional channel, which forms the "0.1" of 5.1, is directed to a subwoofer or bass channel. Other surround sound formats include a 7.1 surround sound format (that adds additional rear left and right channels) and a 22.2 surround sound format (which adds additional channels at varying heights in addition to additional forward and rear channels and another subwoofer or bass channel).

In the context of a 5.1 surround sound format, the A/V receiver may render these five channels for the five loudspeakers 216 and a bass channel for a subwoofer (not shown in the example of FIG. 13A or 13B). The A/V receiver may render the signals to change volume levels and other characteristics of the signal so as to adequately replicate the sound field in the particular room in which the surround sound system operates. That is, the original surround sound audio signal may have been captured and processed to accommodate a given room, such as a 15×15 foot room. The A/V receiver may process this signal to accommodate the room in which the surround sound system operates. The A/V receiver may perform this rendering to create a better sound stage and thereby provide a better or more immersive listening experience.

In the example of FIG. 13B, the speakers 216 are arranged in a rectangular speaker geometry 218, denoted by the dashed line rectangle. This speaker geometry may be similar to or nearly the same as a speaker geometry specified by one or more of the various audio standards noted above. Given the similarities to standardized speaker geometries, the headend device 214 may not transform or otherwise convert audio signals 220 into SHC in the manner described above, but may merely playback these audio signals 220 via speakers 216.

The headend device 214 may however be configurable to perform this transformation even when the speaker geometry 218 is similar to but not identical to that specified in one of the above noted standards in order to potentially generate speaker feeds that better reproduce the intended sound field. In this respect, while similar to those speaker geometries, the headend device 214 may still perform the techniques described above in this disclosure to better reproduce the sound field.

In the example of FIG. 13B, the system 200B is similar to the system 200A in that system 200B also includes the audio source device 212, the headend device 214 and the speakers 216. However, rather than having the speakers 216 arranged in the rectangular speaker geometry 218, the system 200B has the speakers 216 arranged in an irregular speaker geometry 222. Irregular speaker geometry 222 may represent one example of an asymmetric speaker geometry.

As a result of this irregular speaker geometry 222, the user may interface with the headend device 214 to input the locations of each of the speakers 216 such that the headend device 214 is able to specify the irregular speaker geometry 222. The headend device 214 may then perform the techniques described above to transform the input audio signals 220 to the SHC and then transform the SHC to speaker feeds that may best reproduce the sound field given the irregular speaker geometry 222 of the speakers 216.

In the example of FIG. 13C, the system 200C is similar to the system 200A and 200B in that system 200C also includes the audio source device 212, the headend device 214 and the speakers 216. However, rather than having the speakers 216 arranged in the rectangular speaker geometry 218, the system 200C has the speakers 216 arranged in a multi-planar speaker geometry 226. multi-planar speaker geometry 226 may represent one example of an asymmetric multi-planar speaker geometry where at least one speaker does not reside on the same plane, e.g., plane 228 in the example of FIG. 13C, as two or more of the other speakers 216. As shown in the example of FIG. 13C, the right surround speaker 216E has a vertical displacement 230 from the plane 228 to the location of speaker 216E. The remaining speakers 216A-216D are each located on the plane 228, which may be common to each of speakers 216A-216D. Speaker 216E, however, resides on a different plane from the speakers 216A-216D and therefore speakers 216 reside on two or more or in other words multiple planes.

As a result of this multi-planar speaker geometry 228, the user may interface with the headend device 214 to input the locations of each of the speakers 216 such that the headend device 214 is able to specify the multi-planar speaker geometry 226. The headend device 214 may then perform the techniques described above to transform the input audio signals 220 to the SHC and then transform the SHC to speaker feeds that may best reproduce the sound field given the multi-planar speaker geometry 226 of the speakers 216.

Figure 14:
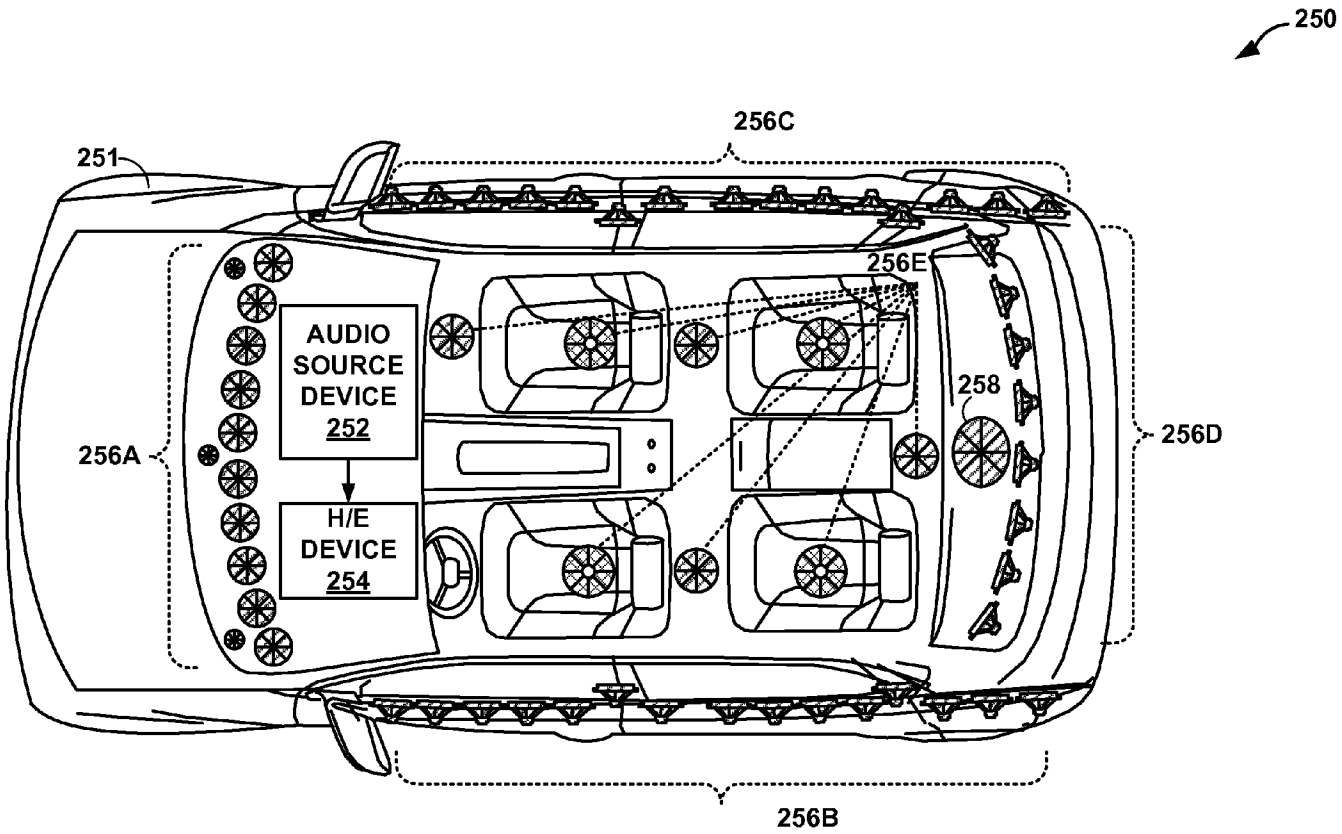
FIG. 14 is a diagram illustrating an automotive sound system that may perform various aspects of the techniques described in this disclosure.

FIG. 14 is a diagram illustrating an automotive sound system 250 that may perform various aspects of the techniques described in this disclosure. As shown in the example of FIG. 14, the automotive sound system 250 includes an audio source device 252 that may be substantially similar to the above described audio source device 212 shown in the example of FIG. 13A-13C. The automotive sound system 250 may also include a headend device 254 ("H/E device 254"), which may be substantially similar to the headend device 214 described above. While shown as being located in a front dash of an automobile 251, one or both of the audio source device 252 and the headend device 254 may be located anywhere within the automobile 251, including, as examples, the floor, the ceiling, or the rear compartment of the automobile.

The automotive sound system 250 further includes front speakers 256A, driver side speakers 256B, passenger side speakers 256C, rear speakers 256D, ambient speakers 256E and a subwoofer 258. Although not individually denoted, each circle and or speaker shaped object in the example of FIG. 14 represents a separate or individual speaker. However, while operating as separate speakers that each receive their own speaker feed, one or more of the speakers may operate in conjunction with another speaker to provide what may be referred to as a virtual speaker located somewhere between two collaborating ones of the speakers.

In this respect, one or more of front speakers 256A may represent a center speaker, similar to the center speaker 216C shown in the examples of FIGS. 13A-13C. One or more of the front speakers 256A may also represent a front-left speaker, similar to the front left speaker 216A, while one or more of the front speakers 256A may, in some instances, represent a front-right speaker, similar to the front-right speaker 216B. In some instances, one or more of driver side speakers 256B may represent a front right speaker, similar to the front right speaker 216B. In some instances, one or more of both of the front speakers 256A and the driver side speakers 256B may represent a front left speaker, similar to the front left speaker 216A. Likewise, in some instances, one or more of the passenger side speakers 256C may represent a front right speaker, similar to the front right speaker 216B. In some instances, one or more of both of the front speakers 256A and the passenger side speakers 256C may represent a front right speaker, similar to the front right speaker 216B.

Moreover, one or more of the driver side speakers 256B may, in some instances, represent a surround left speaker, similar to the surround left speaker 216D. In some instances, one or more of the rear speakers 256D may represent the surround left speaker, similar to the surround left speaker 216D. In some instances, one or more of both the driver side speakers 256B and the rear speakers 256D may represent the surround left speaker, similar to the surround left speaker 216D. Likewise, one or more of the passenger side speakers 256C may, in some instances, represent a surround right speaker, similar to the surround right speaker 216E. In some instances, one or more of the rear speakers 256D may represent the surround right speaker, similar to the surround right speaker 216E. In some instances, one or more of both the passenger side speakers 256C and the rear speakers 256D may represent the surround right speaker, similar to the surround right speaker 216E.

The ambient speakers 256E may represent speakers installed in the floor of the automobile 251, in the ceiling of the automobile 251 or in any other possible interior space of the automobile 251, including the seats, any consoles or other compartments within the automobile 251. The subwoofer 258 represents a speaker designed to reproduce low frequency effects.

The headend device 254 may perform various aspects of the techniques described above to transform backwards compatible signals from audio source device 252 that may be augmented with the extended set to recover SHCs representative of the sound field (often representative of a three-dimensional representation of the sound field, as noted above). As a result of what may be characterized as a comprehensive representation of the sound field, the headend device 254 may then transform the SHC to generate individual feeds for each of the speakers 256A-256E. The headend device 254 may generate speaker feeds in this manner such that, when played via speakers 256A-256E, the sound field may be better reproduced (especially given the relatively large number of speakers 256A-256E in comparison to ordinary automotive sound systems that typically feature at most 10-16 speakers) in comparison to reproduction of sound field using standardized speaker feeds conforming to a standard, as one example.

The methods and apparatus disclosed herein may be applied generally in any transceiving and/or audio sensing application, including mobile or otherwise portable instances of such applications and/or sensing of signal components from far-field sources. For example, the range of configurations disclosed herein includes communications devices that reside in a wireless telephony communication system configured to employ a code-division multiple-access (CDMA) over-the-air interface. Nevertheless, it would be understood by those skilled in the art that a method and apparatus having features as described herein may reside in any of the various communication systems employing a wide range of technologies known to those of skill in the art, such as systems employing Voice over IP (VoIP) over wired and/or wireless (e.g., CDMA, TDMA, FDMA, and/or TD-SCDMA) transmission channels.

It is expressly contemplated and hereby disclosed that communications devices disclosed herein (e.g., smartphones, tablet computers) may be adapted for use in networks that are packet-switched (for example, wired and/or wireless networks arranged to carry audio transmissions according to protocols such as VoIP) and/or circuit-switched. It is also expressly contemplated and hereby disclosed that communications devices disclosed herein may be adapted for use in narrowband coding systems (e.g., systems that encode an audio frequency range of about four or five kilohertz) and/or for use in wideband coding systems (e.g., systems that encode audio frequencies greater than five kilohertz), including whole-band wideband coding systems and split-band wideband coding systems.

The foregoing presentation of the described configurations is provided to enable any person skilled in the art to make or use the methods and other structures disclosed herein. The flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof.

Important design requirements for implementation of a configuration as disclosed herein may include minimizing processing delay and/or computational complexity (typically measured in millions of instructions per second or MIPS), especially for computation-intensive applications, such as playback of compressed audio or audiovisual information (e.g., a file or stream encoded according to a compression format, such as one of the examples identified herein) or applications for wideband communications (e.g., voice communications at sampling rates higher than eight kilohertz, such as 12, 16, 44.1, 48, or 192 kHz).

Goals of a multi-microphone processing system may include achieving ten to twelve dB in overall noise reduction, preserving voice level and color during movement of a desired speaker, obtaining a perception that the noise has been moved into the background instead of an aggressive noise removal, dereverberation of speech, and/or enabling the option of post-processing for more aggressive noise reduction.

An apparatus as disclosed herein (e.g., apparatus A100, MF100) may be implemented in any combination of hardware with software, and/or with firmware, that is deemed suitable for the intended application. For example, the elements of such an apparatus may be fabricated as electronic and/or optical devices residing, for example, on the same chip or among two or more chips in a chipset. One example of such a device is a fixed or programmable array of logic elements, such as transistors or logic gates, and any of these elements may be implemented as one or more such arrays. Any two or more, or even all, of the elements of the apparatus may be implemented within the same array or arrays. Such an array or arrays may be implemented within one or more chips (for example, within a chipset including two or more chips).

One or more elements of the various implementations of the apparatus disclosed herein may also be implemented in whole or in part as one or more sets of instructions arranged to execute on one or more fixed or programmable arrays of logic elements, such as microprocessors, embedded processors, IP cores, digital signal processors, FPGAs (field-programmable gate arrays), ASSPs (application-specific standard products), and ASICs (application-specific integrated circuits). Any of the various elements of an implementation of an apparatus as disclosed herein may also be embodied as one or more computers (e.g., machines including one or more arrays programmed to execute one or more sets or sequences of instructions, also called "processors"), and any two or more, or even all, of these elements may be implemented within the same such computer or computers.

A processor or other means for processing as disclosed herein may be fabricated as one or more electronic and/or optical devices residing, for example, on the same chip or among two or more chips in a chipset. One example of such a device is a fixed or programmable array of logic elements, such as transistors or logic gates, and any of these elements may be implemented as one or more such arrays. Such an array or arrays may be implemented within one or more chips (for example, within a chipset including two or more chips). Examples of such arrays include fixed or programmable arrays of logic elements, such as microprocessors, embedded processors, IP cores, DSPs, FPGAs, ASSPs, and ASICs. A processor or other means for processing as disclosed herein may also be embodied as one or more computers (e.g., machines including one or more arrays programmed to execute one or more sets or sequences of instructions) or other processors. It is possible for a processor as described herein to be used to perform tasks or execute other sets of instructions that are not directly related to an audio coding procedure as described herein, such as a task relating to another operation of a device or system in which the processor is embedded (e.g., an audio sensing device). It is also possible for part of a method as disclosed herein to be performed by a processor of the audio sensing device and for another part of the method to be performed under the control of one or more other processors.

Those of skill will appreciate that the various illustrative modules, logical blocks, circuits, and tests and other operations described in connection with the configurations disclosed herein may be implemented as electronic hardware, computer software, or combinations of both. Such modules, logical blocks, circuits, and operations may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

It is noted that the various methods disclosed herein (e.g., methods M100, M200, M300) may be performed by an array of logic elements such as a processor, and that the various elements of an apparatus as described herein may be implemented as modules designed to execute on such an array. As used herein, the term "module" or "sub-module" can refer to any method, apparatus, device, unit or computer-readable data storage medium that includes computer instructions (e.g., logical expressions) in software, hardware or firmware form. It is to be understood that multiple modules or systems can be combined into one module or system and one module or system can be separated into multiple modules or systems to perform the same functions. When implemented in software or other computer-executable instructions, the elements of a process are essentially the code segments to perform the related tasks, such as with routines, programs, objects, components, data structures, and the like. The term "software" should be understood to include source code, assembly language code, machine code, binary code, firmware, macrocode, microcode, any one or more sets or sequences of instructions executable by an array of logic elements, and any combination of such examples. The program or code segments can be stored in a processor-readable storage medium or transmitted by a computer data signal embodied in a carrier wave over a transmission medium or communication link.

The implementations of methods, schemes, and techniques disclosed herein may also be tangibly embodied (for example, in one or more computer-readable media as listed herein) as one or more sets of instructions readable and/or executable by a machine including an array of logic elements (e.g., a processor, microprocessor, microcontroller, or other finite state machine). The term "computer-readable medium" may include any medium that can store or transfer information, including volatile, nonvolatile, removable and non-removable media. Examples of a computer-readable medium include an electronic circuit, a semiconductor memory device, a ROM, a flash memory, an erasable ROM (EROM), a floppy diskette or other magnetic storage, a CD-ROM/DVD or other optical storage, a hard disk, a fiber optic medium, a radio frequency (RF) link, or any other medium which can be used to store the desired information and which can be accessed. The computer data signal may include any signal that can propagate over a transmission medium such as electronic network channels, optical fibers, air, electromagnetic, RF links, etc. The code segments may be downloaded via computer networks such as the Internet or an intranet. In any case, the scope of the present disclosure should not be construed as limited by such embodiments.

Each of the tasks of the methods described herein may be embodied directly in hardware, in a software module executed by a processor, or in a combination of the two. In a typical application of an implementation of a method as disclosed herein, an array of logic elements (e.g., logic gates) is configured to perform one, more than one, or even all of the various tasks of the method. One or more (possibly all) of the tasks may also be implemented as code (e.g., one or more sets of instructions), embodied in a computer program product (e.g., one or more data storage media such as disks, flash or other nonvolatile memory cards, semiconductor memory chips, etc.), that is readable and/or executable by a machine (e.g., a computer) including an array of logic elements (e.g., a processor, microprocessor, microcontroller, or other finite state machine). The tasks of an implementation of a method as disclosed herein may also be performed by more than one such array or machine. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to receive and/or transmit encoded frames.

It is expressly disclosed that the various methods disclosed herein may be performed by a portable communications device such as a handset, headset, or portable digital assistant (PDA), and that the various apparatus described herein may be included within such a device. A typical real-time (e.g., online) application is a telephone conversation conducted using such a mobile device.

In one or more exemplary embodiments, the operations described herein may be implemented in hardware, software, firmware, or any combination thereof. If implemented in software, such operations may be stored on or transmitted over a computer-readable medium as one or more instructions or code. The term "computer-readable media" includes both computer-readable storage media and communication (e.g., transmission) media. By way of example, and not limitation, computer-readable storage media can comprise an array of storage elements, such as semiconductor memory (which may include without limitation dynamic or static RAM, ROM, EEPROM, and/or flash RAM), or ferroelectric, magnetoresistive, ovonic, polymeric, or phase-change memory; CD-ROM or other optical disk storage; and/or magnetic disk storage or other magnetic storage devices. Such storage media may store information in the form of instructions or data structures that can be accessed by a computer. Communication media can comprise any medium that can be used to carry desired program code in the form of instructions or data structures and that can be accessed by a computer, including any medium that facilitates transfer of a computer program from one place to another. Also, any connection is properly termed a computer-readable medium. For example, if the software is transmitted from a website, server, or other remote source using a coaxial cable, fiber optic cable, twisted pair, digital subscriber line (DSL), or wireless technology such as infrared, radio, and/or microwave, then the coaxial cable, fiber optic cable, twisted pair, DSL, or wireless technology such as infrared, radio, and/or microwave are included in the definition of medium. Disk and disc, as used herein, includes compact disc (CD), laser disc, optical disc, digital versatile disc (DVD), floppy disk and Blu-ray Disc™ (Blu-Ray Disc Association, Universal City, Calif.), where disks usually reproduce data magnetically, while discs reproduce data optically with lasers. Combinations of the above should also be included within the scope of computer-readable media.

An acoustic signal processing apparatus as described herein (e.g., apparatus A100 or MF100) may be incorporated into an electronic device that accepts speech input in order to control certain operations, or may otherwise benefit from separation of desired noises from background noises, such as communications devices. Many applications may benefit from enhancing or separating clear desired sound from background sounds originating from multiple directions. Such applications may include human-machine interfaces in electronic or computing devices which incorporate capabilities such as voice recognition and detection, speech enhancement and separation, voice-activated control, and the like. It may be desirable to implement such an acoustic signal processing apparatus to be suitable in devices that only provide limited processing capabilities.

The elements of the various implementations of the modules, elements, and devices described herein may be fabricated as electronic and/or optical devices residing, for example, on the same chip or among two or more chips in a chipset. One example of such a device is a fixed or programmable array of logic elements, such as transistors or gates. One or more elements of the various implementations of the apparatus described herein may also be implemented in whole or in part as one or more sets of instructions arranged to execute on one or more fixed or programmable arrays of logic elements such as microprocessors, embedded processors, IP cores, digital signal processors, FPGAs, ASSPs, and ASICs.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

What is claimed is:

1. A method of audio signal processing comprising:

performing panning on a first set of audio channel information for a first geometry of speakers to produce a first set of virtual audio channel information;

transforming, with a first transform that is based on a spherical wave model, the first set of virtual audio channel information into a first hierarchical set of elements that describes a sound field; and transforming in a frequency domain, with a second transform, the first hierarchical set of elements into a second set of audio channel information for a second geometry of speakers.

2. The method of claim 1, wherein the first geometry of speakers and second geometry of speakers have different radii.

3. The method of claim 1, wherein the first geometry of speakers and second geometry of speakers have different azimuth.

4. The method of claim 1, wherein the first geometry of speakers and second geometry of speakers have different elevation angle.

5. The method of claim 1, wherein the first hierarchical set of elements comprises spherical harmonic coefficients.

6. The method of claim 5, wherein transforming, with the second transform, comprises transforming, with the second transform, the first hierarchical set of elements into the second set of audio channel information for the second geometry of speakers to compensate for a difference of position between elements in the first geometry of speakers and elements in the second geometry of speakers.

7. The method of claim 1, wherein performing panning on the first set of audio channel information comprises performing vector base amplitude panning on the first set of audio channel information to produce the first set of virtual audio channel information.

8. The method of claim 1, wherein each of the first set of audio channel information is associated with a corresponding different defined region of space.

9. The method of claim 8, wherein the different defined regions of space are defined in one or more of an audio format specification and an audio format standard.

10. The method of claim 1, wherein the second set of audio channel information comprises a second set of virtual audio channel information, wherein each of the second set of audio channel information is associated with a corresponding different region of space, and wherein the method further comprises performing panning on the second set of virtual audio channel information to produce the second set of audio channel information.

11. The method of claim 10, wherein performing panning on the second set of virtual audio channel information comprises performing vector base amplitude panning on the second set of virtual audio channel information to produce the second set of audio channel information.

12. The method of claim 10, wherein each of the second set of virtual audio channel information is associated with a corresponding different defined region of space.

13. The method of claim 12, wherein the different defined regions of space are defined in one or more of an audio format specification and an audio format standard.

14. The method of claim 1, wherein the first set of audio channel information is associated with a first spatial geometry, and wherein the second set of audio channel information is associated with a second spatial geometry that is different than the first spatial geometry.

15. The method of claim 1, wherein the first geometry of speakers is a square geometry.

16. The method of claim 1, wherein the first geometry of speakers is a rectangular geometry.

17. The method of claim 1, wherein the first geometry of speakers is a spherical geometry.

18. The method of claim 1, wherein the second geometry of speakers is a square geometry.

19. The method of claim 1, wherein the second geometry of speakers is a rectangular geometry.

20. The method of claim 1, wherein the second geometry of speakers is a spherical geometry.

21. The method of claim 1, wherein transforming, with the first transform, comprises transforming in a frequency domain, with the first transform that is based on the spherical wave model, the first set of audio channel information for the first geometry of speakers into the first hierarchical set of elements that describes the sound field.

22. An apparatus comprising:

a memory configured to store audio data; and one or more processors for processing at least a portion of the audio data, the one or more processors being configured to:

perform panning on a first set of audio channel information for a first geometry of speakers to produce a first set of virtual audio channel information, perform a first transform that is based on a spherical wave model on the first set of virtual audio channel information to generate a first hierarchical set of elements that describes a sound field; and perform a second transform in a frequency domain on the first hierarchical set of elements to generate a second set of audio channel information for a second geometry of speakers.

23. The apparatus of claim 22, wherein the first geometry of speakers and second geometry have different radii.

24. The apparatus of claim 22, wherein the first geometry of speakers and second geometry have different azimuth.

25. The apparatus of claim 22, wherein the first geometry of speakers and second geometry have different elevation angle.

26. The apparatus of claim 22, wherein the first hierarchical set of elements comprise spherical harmonic coefficients.

27. The apparatus of claim 22, wherein the one or more processors comprise an encoder that is configured to perform the first transform and the second transform.

28. The apparatus of claim 27, wherein the one or more processors are further configured to, when performing the second transform, perform the second transform on the first hierarchical set of elements to generate the second set of audio channel information for the second geometry of speakers to compensate for a difference of position between elements in the first geometry of speakers and elements in the second geometry of speakers.

29. The apparatus of claim 22, wherein the one or more processors are further configured to, when performing panning on the first set of audio channel information, perform vector base amplitude panning on the first set of audio channel information to produce the first set of virtual audio channel information.

30. The apparatus of claim 22, wherein each of the first set of audio channel information is associated with a corresponding different defined region of space.

31. The apparatus of claim 30, wherein the different defined regions of space are defined in one or more of an audio format specification and an audio format standard.

32. The apparatus of claim 22, wherein the second set of audio channel information comprises a second set of virtual audio channel information, wherein each of the second set of audio channel information is associated with a corresponding different region of space, and wherein the one or more processors are further configured to perform panning on the second set of virtual audio channel information to produce the second set of audio channel information.

33. The apparatus of claim 32, wherein the one or more processors are further configured to, when performing panning on the second set of virtual audio channel information, perform vector base amplitude panning on the second set of virtual audio channel information to produce the second set of audio channel information.

34. The apparatus of claim 32, wherein each of the second set of virtual audio channel information is associated with a corresponding different defined region of space.

35. The apparatus of claim 34, wherein the different defined regions of space are defined in one or more of an audio format specification and an audio format standard.

36. The apparatus of claim 22, wherein the first set of audio channel information is associated with a first spatial geometry, and wherein the second set of audio channel information is associated with a second spatial geometry that is different than the first spatial geometry.

37. The apparatus of claim 22, wherein the first geometry of speakers is a square geometry.

38. The apparatus of claim 22, wherein the first geometry of speakers is a rectangular geometry.

39. The apparatus of claim 22, wherein the first geometry of speakers is a spherical geometry.

40. The apparatus of claim 22, wherein the second geometry of speakers is a square geometry.

41. The apparatus of claim 22, wherein the second geometry of speakers is a rectangular geometry.

42. The apparatus of claim 22, wherein the second geometry of speakers is a spherical geometry.

43. The apparatus of claim 22, wherein the one or more processors are configured to, when performing the first transform, perform the first transform in a frequency domain on the first set of audio channel information for the first geometry of speakers to generate the first hierarchical set of elements that describes the sound field.

44. An apparatus comprising:

means for performing panning on a first set of audio channel information for a first geometry of speakers to produce a first set of virtual audio channel information;

means for transforming, with a first transform that is based on a spherical wave model, the first set of virtual audio channel information into a first hierarchical set of elements that describes a sound field; and means for transforming in a frequency domain, with a second transform, the first hierarchical set of elements into a second set of audio channel information for a second geometry of speakers.

45. The apparatus of claim 44, wherein the first geometry of speakers and second geometry have different radii.

46. The apparatus of claim 44, wherein the first geometry of speakers and second geometry have different azimuth.

47. The apparatus of claim 44, wherein the first geometry of speakers and second geometry have different elevation angle.

48. The apparatus of claim 44, wherein the first hierarchical set of elements comprise spherical harmonic coefficients.

49. The apparatus of claim 44, wherein the means for transforming, with the second transform, comprises means for transforming, with the second transform, the first hierarchical set of elements into the second set of audio channel information for the second geometry of speakers to compensate for a difference of position between elements in the first geometry of speakers and elements in the second geometry of speakers.

50. The apparatus of claim 44, wherein the means for performing panning on the first set of audio channel information comprises means for performing vector base amplitude panning on the first set of audio channel information to produce the first set of virtual audio channel information.

51. The apparatus of claim 44, wherein each of the first set of audio channel information is associated with a corresponding different defined region of space.

52. The apparatus of claim 51, wherein the different defined regions of space are defined in one or more of an audio format specification and an audio format standard.

53. The apparatus of claim 44, wherein the second set of audio channel information comprises a second set of virtual audio channel information, wherein each of the second set of audio channel information is associated with a corresponding different region of space, and wherein the apparatus further comprises means for performing panning on the second set of virtual audio channel information to produce the second set of audio channel information.

54. The apparatus of claim 53, wherein performing panning on the second set of virtual audio channel information comprises performing vector base amplitude panning on the second set of virtual audio channel information to produce the second set of audio channel information.

55. The apparatus of claim 44, wherein each of the second set of virtual audio channel information is associated with a corresponding different defined region of space.

56. The apparatus of claim 55, wherein the different defined regions of space are defined in one or more of an audio format specification and an audio format standard.

57. The apparatus of claim 44, wherein the first set of audio channel information is associated with a first spatial geometry, and wherein the second set of audio channel information is associated with a second spatial geometry that is different than the first spatial geometry.

58. The apparatus of claim 44, wherein the first geometry of speakers is a square geometry.

59. The apparatus of claim 44, wherein the first geometry of speakers is a rectangular geometry.

60. The apparatus of claim 44, wherein the first geometry of speakers is a spherical geometry.

61. The apparatus of claim 44, wherein the second geometry of speakers is a square geometry.

62. The apparatus of claim 44, wherein the second geometry of speakers is a rectangular geometry.

63. The apparatus of claim 44, wherein the second geometry of speakers is a spherical geometry.

64. The apparatus of claim 44, wherein the means for transforming, with the first transform, comprises means for transforming in a frequency domain, with the first transform that is based on the spherical wave model, the first set of audio channel information for the first geometry of speakers into the first hierarchical set of elements that describes the sound field.

65. A non-transitory computer-readable storage medium having stored thereon instructions that, when executed, cause one or more processors to:

perform panning on a first set of audio channel information for a first geometry of speakers to produce a first set of virtual audio channel information;

transform, with a first transform that is based on a spherical wave model, the first set of virtual audio channel information into a first hierarchical set of elements that describes a sound field; and transform in a frequency domain, with a second transform, the first hierarchical set of elements into a second set of audio channel information for a second geometry of speakers.

66. A method comprising:

receiving loudspeaker channels along with coordinates of a first geometry of speakers;

performing panning on the loudspeaker channels based on the coordinates of the first geometry of speakers to produce virtual loudspeaker channels; and transforming, with a first transform that is based on a spherical wave model, the virtual loudspeaker channels to produce a hierarchical set of elements that describes a sound field.

67. The method of claim 66, wherein the loudspeaker channels and coordinates of the first geometry are mapped to a second geometry of speakers.

68. The method of claim 67, wherein the first geometry of speakers and second geometry have different radii.

69. The method of claim 67, wherein the first geometry of speakers and second geometry have different azimuth.

70. The method of claim 67, wherein the first geometry of speakers and second geometry have different elevation angle.

71. The method of claim 67, wherein the first hierarchical set of elements comprises spherical harmonic coefficients.

72. The method of claim 67, wherein the loudspeaker channels and coordinates of the first geometry are mapped to the second geometry of speakers to compensate for a difference of position between elements in the first geometry of speakers and elements in the second geometry of speakers.

73. The method of claim 66, wherein performing panning on the loudspeaker channels comprises performing vector base amplitude panning on the loudspeaker channels to produce the virtual loudspeaker channels.

74. The method of claim 66, wherein each of the loudspeaker channels is associated with a corresponding different defined region of space.

75. The method of claim 74, wherein the different defined regions of space are defined in one or more of an audio format specification and an audio format standard.

76. The method of claim 66, further comprising:

transforming in a frequency domain, with a second transform that is based on a spherical wave model, the hierarchical set of elements into virtual loudspeaker channels; and performing panning on the virtual loudspeaker channels to produce different loudspeaker channels, wherein each of the different loudspeaker channels is associated with a corresponding different region of space.

77. The method of claim 76, wherein performing panning on the virtual loudspeaker channels comprises performing vector base amplitude panning on the virtual loudspeaker channels to produce the different loudspeaker channels.

78. The method of claim 76, wherein each of the virtual loudspeaker channels is associated with a corresponding different defined region of space.

79. The method of claim 78, wherein the different defined regions of space are defined in one or more of an audio format specification and an audio format standard.

80. The method of claim 76, wherein the loudspeaker channels are associated with a first spatial geometry, and wherein the different loudspeaker channels are associated with a second spatial geometry that is different than the first spatial geometry.

81. An apparatus comprising:

a memory configured to store audio data; and one or more processors for processing at least a portion of the audio data; the one or more processors being configured to:

receive loudspeaker channels along with coordinates of a first geometry of speakers;

perform panning on the loudspeaker channels based on coordinates of the first geometry of speakers to produce virtual loudspeaker channels; and transform, with a first transform that is based on a spherical wave model, the virtual loudspeaker channels to produce a hierarchical set of elements that describes a sound field.

82. The apparatus of claim 81, wherein the loudspeaker channels and coordinate of the first geometry are mapped to a second geometry of speakers.

83. The apparatus of claim 82, wherein the first geometry of speakers and second geometry have different radii.

84. The apparatus of claim 82, wherein the first geometry of speakers and second geometry have different azimuth.

85. The apparatus of claim 82, wherein the first geometry of speakers and second geometry have different elevation angle.

86. The apparatus of claim 82, wherein the first hierarchical set of elements comprise spherical harmonic coefficients.

87. The apparatus of claim 82, wherein the processor comprises a decoder.

88. The apparatus of claim 87, wherein the loudspeaker channels and coordinates of the first geometry are mapped to the second geometry of speakers to compensate for a difference of position between elements in the first geometry of speakers and elements in the second geometry of speakers.

89. The apparatus of claim 81, wherein the one or more processors are further configured to, when performing panning on the loudspeaker channels, perform vector base amplitude panning on the loudspeaker channels based on the coordinates of the first geometry of speakers to produce the virtual loudspeaker channels.

90. The apparatus of claim 81, wherein each of the loudspeaker channels is associated with a corresponding different defined region of space.

91. The apparatus of claim 90, wherein the different defined regions of space are defined in one or more of an audio format specification and an audio format standard.

92. The apparatus of claim 81, wherein the one or more processors are further configured to transform in a frequency domain, with a second transform that is based on a spherical wave model, the hierarchical set of elements into the virtual loudspeaker channels, and perform panning on the virtual loudspeaker channels to produce different loudspeaker channels, wherein each of the different loudspeaker channels is associated with a corresponding different region of space.

93. The apparatus of claim 92, wherein the one or more processors are further configured to, when performing panning on the second set of virtual audio channel information, perform vector base amplitude panning on the virtual loudspeaker channels to produce the different loudspeaker channels.

94. The apparatus of claim 92, wherein each of the virtual loudspeaker channels is associated with a corresponding different defined region of space.

95. The apparatus of claim 94, wherein the different defined regions of space are defined in one or more of an audio format specification and an audio format standard.

96. The apparatus of claim 92, wherein the loudspeaker channels are associated with a first spatial geometry, and wherein the different loudspeaker channels are associated with a second spatial geometry that is different than the first spatial geometry.

97. An apparatus comprising:

means for receiving loudspeaker channels along with coordinates of a first geometry of speakers;

means for performing panning on the loudspeaker channels based on the coordinates of the first geometry of speakers to produce virtual loudspeaker channels; and means for transforming, with a first transform that is based on a spherical wave model, the virtual loudspeaker channels to produce a hierarchical set of elements that describes a sound field.

98. The apparatus of claim 97, wherein the loudspeaker channels the coordinates of the first geometry are mapped to a second geometry of speakers.

99. The apparatus of claim 98, wherein the first geometry of speakers and second geometry have different radii.

100. The apparatus of claim 98, wherein the first geometry of speakers and second geometry have different azimuth.

101. The apparatus of claim 98, wherein the first geometry of speakers and second geometry have different elevation angle.

102. The apparatus of claim 98, wherein the first hierarchical set of elements comprise spherical harmonic coefficients.

103. The apparatus of claim 98, wherein the loudspeaker channels and coordinates of the first geometry are mapped to the second geometry of speakers to compensate for a difference of position between elements in the first geometry of speakers and elements in the second geometry of speakers.

104. The apparatus of claim 98, wherein the means for performing panning on the loudspeaker channels comprises means for performing vector base amplitude panning on the loudspeaker channels to produce the virtual loudspeaker channels.

105. The apparatus of claim 98, wherein each of the loudspeaker channels is associated with a corresponding different defined region of space.

106. The apparatus of claim 105, wherein the different defined regions of space are defined in one or more of an audio format specification and an audio format standard.

107. The apparatus of claim 98, further comprising:

means for transforming in a frequency domain, with a second transform that is based on a spherical wave model, the hierarchical set of elements into virtual loudspeaker channels; and means for performing panning on the virtual loudspeaker channels to produce different loudspeaker channels, wherein each of different loudspeaker channels is associated with a corresponding different region of space.

108. The apparatus of claim 107, wherein the means for performing panning on the virtual loudspeaker channels comprises means for performing vector base amplitude panning on the virtual loudspeaker channels to produce the different loudspeaker channels.

109. The apparatus of claim 107, wherein each of the virtual loudspeaker channels is associated with a corresponding different defined region of space.

110. The apparatus of claim 109, wherein the different defined regions of space are defined in one or more of an audio format specification and an audio format standard.

111. The apparatus of claim 107, wherein the loudspeaker channels are associated with a first spatial geometry, and wherein the different loudspeaker channels are is associated with a second spatial geometry that is different than the first spatial geometry.

112. A non-transitory computer-readable storage medium comprising instructions that, when executed, cause one or more processors to:

receive loudspeaker channels along with coordinates of a first geometry of speakers;

perform panning on the loudspeaker channels based on coordinates of the first geometry of speakers to produce virtual loudspeaker channels; and transform, with a first transform that is based on a spherical wave model, the virtual loudspeaker channels to produce a hierarchical set of elements that describes a sound field.

113. A method comprising:

performing panning on loudspeaker channels based on coordinates of a first geometry of speakers to produce virtual loudspeaker channels, wherein the first geometry corresponds to locations of the virtual loudspeaker channels;

transmitting the loudspeaker channels along with the coordinates of the first geometry of speakers; and transforming, with a first transform that is based on a spherical wave model, the virtual loudspeaker channels to produce a hierarchical set of elements that describes a sound field.

114. The method of claim 113, wherein producing the hierarchical set of elements that describes the sound field comprises transforming, with the first transform, a first set of audio channel information from the first geometry of speakers.

115. The method of claim 114, further comprising transforming, with a second transform, the first hierarchical set of elements into a second set of audio channel information for a second geometry of speakers.

116. The method of claim 115, wherein transforming the first hierarchical set of elements, with the second transform, into the second set of audio channel information for the second geometry of speakers comprises compensating for a difference of position between one or more elements in the first geometry of speakers and one or more elements in the second geometry of speakers.

117. The method of claim 113, wherein performing panning on the loudspeaker channels comprises performing vector base amplitude panning on the loudspeaker channels to produce the virtual loudspeaker channels.

118. The method of claim 113, wherein each of the loudspeaker channels is associated with a corresponding different defined region of space.

119. The method of claim 118, wherein the different defined regions of space are defined in one or more of an audio format specification and an audio format standard.

120. The method of claim 113, further comprising:

transforming in a frequency domain, with a second transform that is based on a spherical wave model, the hierarchical set of elements into the virtual loudspeaker channels; and performing panning on the virtual loudspeaker channels to produce different loudspeaker channels, wherein each of different loudspeaker channels is associated with a corresponding different region of space.

121. The method of claim 120, wherein performing panning one the virtual loudspeaker channels comprises performing vector base amplitude panning on the virtual loudspeaker channels to produce the different loudspeaker channels.

122. The method of claim 121, wherein each of the virtual loudspeaker channels is associated with a corresponding different defined region of space.

123. The method of claim 122, wherein the different defined regions of space are defined in one or more of an audio format specification and an audio format standard.

124. The method of claim 120, wherein the loudspeaker channels are associated with a first spatial geometry, and wherein the different loudspeaker channels are associated with a second spatial geometry that is different than the first spatial geometry.

125. An apparatus comprising:

a memory configured to store audio data; and one or more processors for processing at least a portion of the audio data, the one or more processors being configured to:

perform panning on loudspeaker channels based on coordinates of a first geometry of speakers to produce virtual loudspeaker channels, wherein the first geometry of speakers corresponds to locations of the virtual loudspeaker channels;

transmit loudspeaker channels along with coordinates of the first geometry of speakers; and transform, with a first transform that is based on a spherical wave model, the virtual loudspeaker channels to produce a hierarchical set of elements that describes a sound field.

126. The apparatus of claim 125, wherein to produce the hierarchical set of elements that describes the sound field, the one or more processors are configured to transform, with the first transform, a first set of audio channel information for the first geometry of speakers.

127. The apparatus of claim 126, wherein the one or more processors are further configured to transform, with a second transform, the first hierarchical set of elements in a frequency domain, into a second set of audio channel information for a second geometry of speakers.

128. The apparatus of claim 127, wherein to transform the first hierarchical set of elements with the second transform into the second set of audio channel information for the second geometry of speakers, the one or more processors are configured to compensate for a difference of position between elements in the first geometry of speakers and elements in the second geometry of speakers.

129. The apparatus of claim 125, wherein the one or more processors are further configured to, when performing panning on the loudspeaker channels, perform vector base amplitude panning on the loudspeaker channels to produce the virtual loudspeaker channels.

130. The apparatus of claim 125, wherein each of the loudspeaker channels is associated with a corresponding different defined region of space.

131. The apparatus of claim 130, wherein the different defined regions of space are defined in one or more of an audio format specification and an audio format standard.

132. The apparatus of claim 125, wherein the one or more processors are further configured to transform in a frequency domain, with a second transform that is based on a spherical wave model, the hierarchical set of elements into virtual loudspeaker channels, and perform panning on the virtual loudspeaker channels to produce different loudspeaker channels, wherein each of different loudspeaker channels is associated with a corresponding different region of space.

133. The apparatus of claim 132, wherein the one or more processors are further configured to, when performing panning one the virtual loudspeaker channels, perform vector base amplitude panning on the virtual loudspeaker channels to produce the different loudspeaker channels.

134. The apparatus of claim 132, wherein each of the virtual loudspeaker channels is associated with a corresponding different defined region of space.

135. The apparatus of claim 134, wherein the different defined regions of space are defined in one or more of an audio format specification and an audio format standard.

136. The apparatus of claim 132, wherein the loudspeaker channels are associated with a first spatial geometry, and wherein the different loudspeaker channels are associated with a second spatial geometry that is different than the first spatial geometry.

137. An apparatus comprising:

means for performing panning on loudspeaker channels based coordinates of a first geometry of speakers to produce virtual loudspeaker channels, wherein the first geometry corresponds to locations of the virtual loudspeaker channels;

means for transmitting the loudspeaker channels along with coordinates of the first geometry of speakers; and means for transforming, with a first transform that is based on a spherical wave model, the virtual loudspeaker channels to produce a hierarchical set of elements that describes a sound field.

138. The apparatus of claim 137, wherein the means for transforming the virtual loudspeaker channels comprises means for transforming, with the first transform, a first set of audio channel information for the first geometry of speakers.

139. The apparatus of claim 138, further comprising means for transforming, with a second transform, the first hierarchical set of elements into a second set of audio channel information for a second geometry of speakers.

140. The apparatus of claim 139, wherein the means for transforming the first hierarchical set of elements with the second transform into the second set of audio channel information for the second geometry of speakers comprises means for compensating for a difference of position between elements in the first geometry of speakers and elements in the second geometry of speakers.

141. The apparatus of claim 137, wherein the means for performing panning on the loudspeaker channels comprises means for performing vector base amplitude panning on the loudspeaker channels to produce the virtual loudspeaker channels.

142. The apparatus of claim 137, wherein each of the loudspeaker channels is associated with a corresponding different defined region of space.

143. The apparatus of claim 142, wherein the different defined regions of space are defined in one or more of an audio format specification and an audio format standard.

144. The apparatus of claim 137, further comprising:

means for transforming in a frequency domain, with a second transform that is based on a spherical wave model, the hierarchical set of elements into virtual loudspeaker channels; and means for performing panning on the virtual loudspeaker channels to produce different loudspeaker channels, wherein each of different loudspeaker channels is associated with a corresponding different region of space.

145. The apparatus of claim 144, wherein the means for performing panning on the virtual loudspeaker channels comprises means for performing vector base amplitude panning on the virtual loudspeaker channels to produce the different loudspeaker channels.

146. The apparatus of claim 144, wherein each of the virtual loudspeaker channels is associated with a corresponding different defined region of space.

147. The apparatus of claim 146, wherein the different defined regions of space are defined in one or more of an audio format specification and an audio format standard.

148. The apparatus of claim 144, wherein the loudspeaker channels are associated with a first spatial geometry, and wherein the different loudspeaker channels are associated with a second spatial geometry that is different than the first spatial geometry.

149. A non-transitory computer-readable storage medium having stored thereon instructions that, when executed, cause one or more processors to:

perform panning on loudspeaker channels based on coordinates of a first geometry of speakers to produce virtual loudspeaker channels, wherein the first geometry corresponds to locations of the virtual loudspeaker channels;

transmit loudspeaker channels along with coordinates of the first geometry of speakers; and transform, with a first transform that is based on a spherical wave model, the virtual loudspeaker channels to produce a hierarchical set of elements that describes a sound field.

* * * * *